US008563907B2

(12) United States Patent
Bushman et al.

(10) Patent No.: US 8,563,907 B2
(45) Date of Patent: Oct. 22, 2013

(54) RADIOPHARMACEUTICAL HEATER

(75) Inventors: Michael J. Bushman, Bunker Hill, IL (US); Stefan S. Jelesnianski, O'Fallon, MO (US); Michael R. Mahoney, Wentzville, MO (US)

(73) Assignee: Mallinckrodt LLC, Hazelwood, MO (US)

( * ) Notice: Subject to any disclaimer, the term of this patent is extended or adjusted under 35 U.S.C. 154(b) by 312 days.

(21) Appl. No.: 12/919,528

(22) PCT Filed: Feb. 17, 2009

(86) PCT No.: PCT/US2009/034225

§ 371 (c)(1), (2), (4) Date: Aug. 26, 2010

(87) PCT Pub. No.: WO2009/108530

PCT Pub. Date: Sep. 3, 2009

(65) Prior Publication Data

US 2011/0008222 A1 Jan. 13, 2011

Related U.S. Application Data

(60) Provisional application No. 61/031,417, filed on Feb. 26, 2008.

(51) Int. Cl.
*H05B 6/76* (2006.01)

(52) U.S. Cl.
USPC ..... 219/736; 219/535; 219/459; 219/729

(58) Field of Classification Search
USPC ..... 219/535, 459.1, 407–410, 729–731, 219/736
See application file for complete search history.

(56) References Cited

U.S. PATENT DOCUMENTS

| | | | | |
|---|---|---|---|---|
| 4,382,512 | A | 5/1983 | Furminger | |
| 4,865,986 | A | 9/1989 | Coy et al. | |
| 4,898,091 | A * | 2/1990 | Rozak et al. | 99/336 |
| 5,397,902 | A * | 3/1995 | Castner et al. | 250/432 PD |
| 5,678,684 | A * | 10/1997 | Wright | 206/204 |
| 6,004,292 | A | 12/1999 | Battiato et al. | |
| 6,082,114 | A | 7/2000 | Leonoff | |
| 2002/0030044 | A1 * | 3/2002 | Brown | 219/386 |
| 2004/0026046 | A1 | 2/2004 | Broadbent | |
| 2004/0043220 | A1 * | 3/2004 | Hirose et al. | 428/408 |

FOREIGN PATENT DOCUMENTS

| | | |
|---|---|---|
| EP | 1 188 995 | 3/2002 |
| FR | 2 842 289 | 1/2004 |
| GB | 2 084 437 | 4/1982 |
| GB | 2 293 235 | 3/1996 |
| JP | 6 312009 | 11/1994 |
| JP | 200566383 | * 3/2005 |
| WO | WO 2006/124775 | 11/2006 |
| WO | WO 2007/011326 | 1/2007 |
| WO | WO 2007/083177 | 7/2007 |

* cited by examiner

*Primary Examiner* — Steven Loke
*Assistant Examiner* — Cuong B Nguyen

(57) ABSTRACT

A radiopharmaceutical heater includes a heat-transfer member having a receptacle defined therein to receive a container (e.g., a vial). The heat-transfer member has a thermal conductivity greater than about 100 W/(mK) A radiation shield is disposed about the heat-transfer member wherein the radiation shield comprises lead, tungsten, tungsten-impregnated plastic, depleted uranium, or any combination thereof. A heating element is in thermal communication with the heat-transfer member wherein at least a portion of the heating element is located within the radiation shield. The heater includes compliant heat-transfer member shaped to receive the container.

14 Claims, 30 Drawing Sheets

RADIOPHARMACEUTICAL HEATER

CROSS REFERENCE TO RELATED APPLICATIONS

This application is a national stage application of PCT/US2009/034225, filed Feb. 17, 2009, which claims the benefit of U.S. Provisional Application No. 61/031,417, filed Feb. 26, 2008.

FIELD OF THE INVENTION

The invention relates to radiopharmaceutical heaters such as those used in preparing radiopharmaceuticals.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Certain types of radiopharmaceuticals are prepared utilizing heat. In some radiopharmaceutical preparation processes, radiopharmaceutical precursors/reactants are placed into a container (e.g., a vial), and the container is then placed in a heater. The heater elevates the temperature of the components in the vial until the radiopharmaceutical is ready for use (e.g., until components in the vial have reacted with one another as desired). Conventional radiopharmaceutical heaters employ a variety of techniques to transfer heat to the container. For instance, some radiopharmaceutical heaters employ a liquid heat bath to convey heat to the contents in the container.

Some existing radiopharmaceutical heaters are inefficient and/or difficult to clean. For example, containers placed in heated water baths may contaminate the water, resulting in an undesired volume of radioactive material for which appropriate disposal is required. Solid radiopharmaceutical heater blocks may be easier to clean, but the amount of time that some heater blocks take to heat the container is often undesirable. In radiopharmacies, this undesired delay can increase cost and/or cause delay in the preparation and/or delivery of radiopharmaceutical doses. It is believed that a reason for this undesirably inefficient heating may be variations in the shape and size of containers relative to a fixed shape of a container receptacle in a particular radiopharmaceutical heater block. As a result of these variations, the container receptacle in the heater block may only contact the container at limited locations or even not at all. As such, conductive heat transfer is limited (or effectively absent in some instances) such that the container takes an undesirably long time to reach a target temperature.

Some radiopharmaceutical heaters may include lids that are difficult to operate. For example, some existing radiopharmaceutical heaters include lids having handles that pass over a radioactive container in the heater when the lid is being moved between open and closed positions. Generally, a technician attempts to avoid placing part of his body in a direct line-of-sight with the radioactive container to reduce radiation exposure. To this end, technicians often use forceps (or other appropriate tools) to manipulate the lids of the radiopharmaceutical heaters. As such, some technicians tend to assume awkward positions when manipulating the lid of the radiopharmaceutical heater (by way of the handle) to avoid positioning themselves directly over the container.

SUMMARY

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A first aspect of the invention is directed to a radiopharmaceutical heater. The heater includes a compliant heat-transfer member (e.g., a soft, pliable body of material that readily conducts heat) that is shaped (which includes the ability to conform its shape) to receive a container, such as a container having a radiopharmaceutical disposed therein. Incidentally, a "radiopharmaceutical" herein refers to any radioactive medical fluid designed to be administered to a medical patient, as well as to any precursor(s)/reactant(s), which may or may not be radioactive, utilized in making such radioactive medical fluid (e.g., a radioactive technetium-99 solution and/or sestamibi product reactants). The radiopharmaceutical heater also includes a radiation shield disposed near the compliant heat-transfer member and a heating element in thermal communication with the compliant heat-transfer member. Herein, "in thermal communication with" or the like refers to two things being directly or indirectly in contact with one another in a fashion such that heat may be conveyed (e.g., transferred) therebetween.

Embodiments in accordance with the first aspect of the invention may include heaters having a variety of features. The compliant heat-transfer member may include any appropriate material such as, but not limited to, silicone, polytetraflouroethane (e.g., Teflon™), and combinations thereof. In the event that a container is located within the compliant heat-transfer member, the container may contain any appropriate substance (e.g., radioactive substance such as technetium sestamibi). In some embodiments, it is preferred to have the container in direct contact with the compliant heat-transfer member.

In some embodiments of the first aspect, the radiation shield may include first and second radiation-shield members. The second radiation-shield member may be coupled to (i.e., directly or indirectly connected with) the first radiation-shield member via two or fewer degrees of freedom of relative movement between the first radiation-shield member and the second radiation-shield member. As such, one of the radiation-shield members may be able to move (e.g., rotate or translate) about or along one or two axes relative to the other radiation-shield member.

In some embodiments of the first aspect of the invention, the radiopharmaceutical heater may include a shaft, a cam affixed to the shaft, a lever that is affixed to the shaft and is configured to rotate the cam, and a guide-member coupled to the first radiation-shield member. The cam may be configured to move the first radiation-shield member along a path defined by the guide member; this path may be toward the second radiation-shield member.

In some embodiments of the first aspect, a portion (e.g., an entirety) of the heating element may be located within the radiation shield. The radiation shield may include any appropriate radiation shielding material such as, but not limited to, lead, tungsten, tungsten-impregnated plastic, depleted uranium, and combinations thereof.

A second aspect of the invention is directed to a method of heating a radiopharmaceutical. In this method, a container that has a radiopharmaceutical disposed therein is placed at least partially within a heater, which includes what may be referred to as first and second members. While located in the heater, force is applied to the container by moving the first member, the second member, or both. Further, while located in the heater, heat is conducted to the container through the first member, the second member, or both.

In some embodiments of the second aspect of the invention, the first and/or second members may include radiation shielding (such as one or more of those listed above with regard to the first aspect of the invention). In some embodiments, applying the force to the container includes compressing an intermediate member against the container using the first member and/or the second member. In some embodiments, applying the force to the container includes transmitting a load from a lid of the heater to the second member (e.g., by compressing a spring using the load from the lid).

The method of this second aspect can be utilized to heat the contents of any appropriate container to any desired temperature. Further, this heating can be accomplished in any appropriate duration of time. For instance in some embodiments, the container may be heated to a temperature greater than 100 degrees centigrade from room temperature within less than about 10 minutes of beginning to heat the container.

A third aspect of the invention is directed to a radiopharmaceutical heater. The heater includes radiation shielding that is disposed at least partially about a container receptacle of the heater. A heating element of the heater is configured to heat a container in the container receptacle. Further, a spill tray (i.e., a receptacle designed to catch spills) of the heater is disposed at least partially under the radiation shielding.

In some embodiments of the third aspect, the spill tray may include a slide rail (e.g. to facilitate insertion and removal of the spill tray relative to a remainder of the heater). The heater may include a plurality of container receptacles and a plurality of spill trays, each of which may be disposed under a corresponding container receptacle. In some embodiments, the spill tray(s) may include an absorbent medium (e.g., a disposable sponge).

A fourth aspect of the invention is directed to a radiopharmaceutical heater. The heater includes a heater block having a container receptacle in which a container (e.g., having a radiopharmaceutical therein) is disposed. The radiopharmaceutical heater also includes a member that biases the container against the heater block either directly or indirectly (e.g., via an intermediate member), and radiation shielding disposed near (e.g., about) the container.

The member of the radiopharmaceutical heater of the fourth aspect can be designed to bias the container against the heating block in any appropriate fashion. For instance, in some embodiments, the member that biases the container may include a spring to at least assist in providing a biasing force. In some embodiments, the heater may include a lid that biases the member.

The radiopharmaceutical heater of the fourth aspect may be designed in any appropriate manner that allows control of initiation of the biasing of the member against the container. For instance, in some embodiments, the heater may include a button (which may be pressed by a technician) designed to initiate the biasing of the member against the container.

The radiopharmaceutical heater of the fourth aspect may include any appropriate quantity of biasing members. For instance, in some embodiments, the heater includes a plurality of members, each biasing a container against the heater block.

The heater block associated with this fourth aspect of the invention may be any appropriate heater block (e.g., a resistive heater). Moreover, the heater block may be designed to accommodate any number of containers. For instance, the heater block may include a plurality of receptacles, each of which is designed to accommodate one or more containers.

Some embodiments of the fourth aspect may include a compliant heat-transfer member. This compliant heat-transfer member may be located in any appropriate location relative to other components of the radiopharmaceutical heater. For instance, in some embodiments, the compliant heat-transfer member may be disposed between the container and the heater block.

A fifth aspect of the invention is directed to a radiopharmaceutical heater that includes a body having a receptacle. A container (e.g., having a radiopharmaceutical disposed therein) is disposed in the receptacle. In addition, a lid is moveably coupled to the body and designed to move (e.g., pivot) between an open position and a closed position. This lid includes a handle that does not pass directly over the container when the lid moves between the open position and the closed position.

In some embodiments of the fifth aspect of the invention, the lid is coupled to the body by a hinge. In some embodiments, the handle is disposed near a distal portion of the lid. The handle, in some embodiments, may be disposed to one side of the lid. In some embodiments, the heater may include a member that is biased against the container via the lid.

A sixth aspect of the invention is directed to a device for handling radiopharmaceuticals. The device includes a first radiation-shield member, a second radiation-shield member having one degree of freedom relative to the first radiation-shield member, and a driver configured to cause the first radiation-shield member and the second radiation-shield member to translate relative to one another.

In some embodiments of the sixth aspect of the invention, each of the first radioactive shield-member and the second radioactive shield-member includes a complementary interface configured to obstruct generally linear paths of radiation emitted from the container. In some embodiments, the driver includes a manually-actuated lever. In some embodiments, the driver includes an automatic driver. In some embodiments, the device may include an electric heater coupled to the first radiation-shield member, the second radiation-shield member, or both.

A seventh aspect of the invention is directed to a radiopharmaceutical heater that includes a heat-transfer member with a receptacle for receiving a container (e.g., having a radiopharmaceutical disposed therein). The heat-transfer member has a thermal conductivity greater than about 100 W/(mK). In some embodiments, the heat-transfer member is made of aluminum. A radiation shield of lead, tungsten, tungsten-impregnated plastic, depleted uranium, or any combination thereof is associated with the heat-transfer member. A heating element is in thermal communication with the heat-transfer member and at least a portion of the heating element is located within the radiation shield. In some embodiments of the seventh aspect, at least a portion of the heating element is located within the heat-transfer member. In some embodiments, the clearance between the container and the portion of the heat-transfer member that defines the receptacle (i.e., a wall) is no more than about 0.001 inches (0.0254 mm).

An eighth aspect of the invention is directed to a radiopharmaceutical heater having a body and a heater block received in the body. The heater block has a plurality of receptacles defined therein to receive a plurality of containers (e.g., each having a radiopharmaceutical disposed therein). A radiation shield is disposed about the heater block. In some embodiments, the heater block has four receptacles for receiving four containers. In some embodiments, the receptacles in the heat-transfer member are sized and shaped to accommodate at least 50% of a container. In some embodiments, the radiopharmaceutical heater also includes electronics that are spaced from the heater block. In some embodiments, an insulating barrier is disposed between the electronics and the heater block.

Various refinements exist of the features noted above in relation to the various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE FIGURES

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
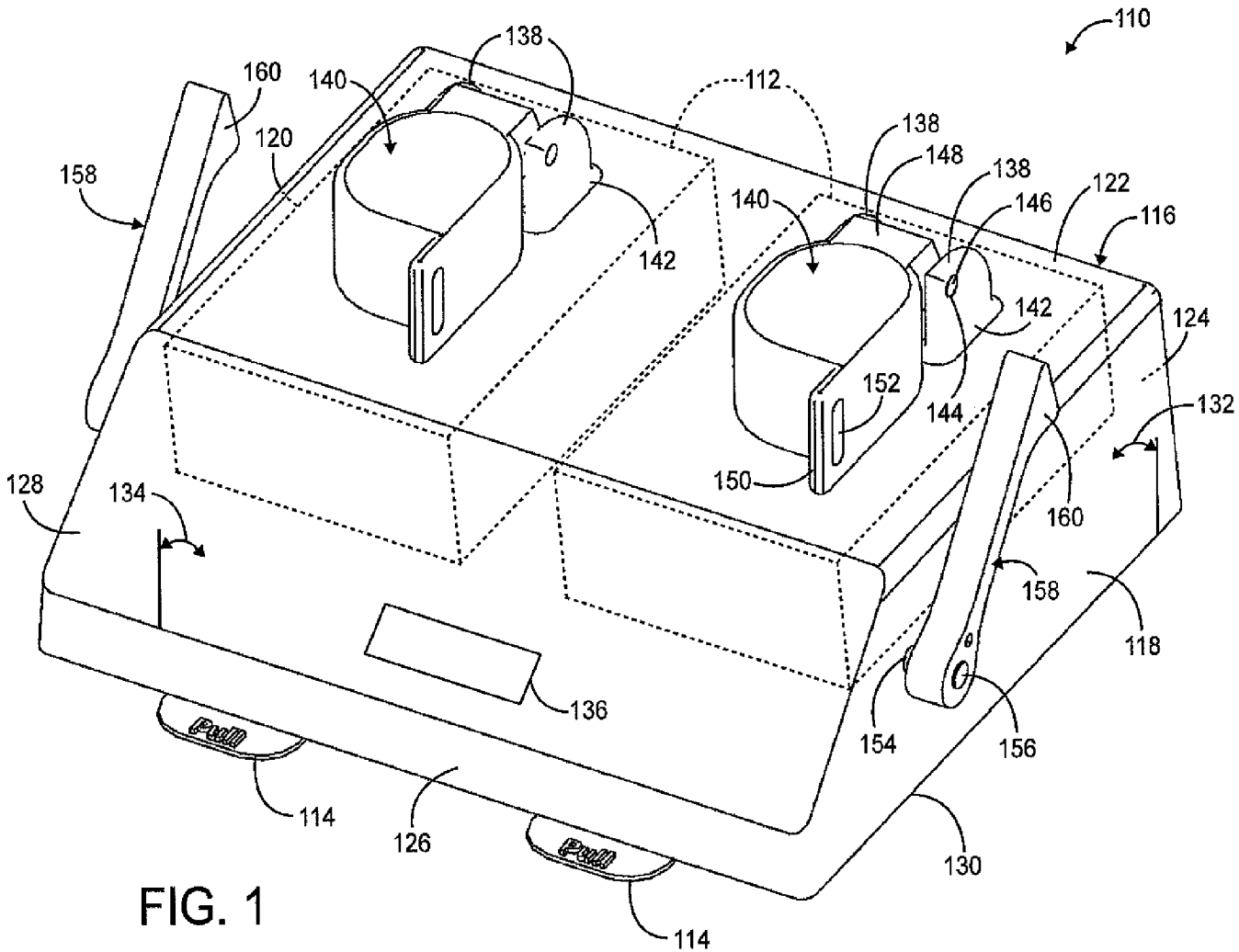
FIG. 1 is a perspective view of a radiopharmaceutical heater.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a", "an", "the", and "said" are intended to mean that there are one or more of the elements. The terms "comprising", "including", and "having" are intended to be inclusive and mean that there may be additional elements other than the listed elements. Moreover, the use of "top", "bottom", "above", "below" and variations of these terms is made for convenience, but does not require any particular orientation of the components.

As explained below, certain embodiments of the invention may enhance heat transfer to a container by biasing the container against a heater block of the corresponding radiopharmaceutical heater. Some embodiments may include a compliant member disposed between the container and the heater block to enhance heat transfer. Some embodiments may include one or more spill trays configured to mitigate spills of radioactive material and/or to facilitate disposal of such radioactive material. Some embodiments may include lids having handles that do not move directly over the containers (e.g., to reduce radiation exposure for technicians utilizing the radiopharmaceutical heater).

FIGS. 1-9 illustrate a radiopharmaceutical heater 110 that includes two heater units 112 (e.g., independently operating heating devices) and two trays 114. Each of the heater units 112 includes a compliant member 218 (see FIGS. 5-9) that conforms to the shape of a container 166 and one or more moving components configured to bias the container 166 against the compliant member 218 and/or a heater block 212. (Several examples of compliant members and their mechanical properties, such as measurements of the ease with which they deform and conduct heat, are described and quantified below.) Together, or in isolation, these features are believed to increase the rate of heat transfer (e.g., conductive heat transfer) to the contents within the container 166. Each of the two trays 114 includes a reservoir 184 to capture spills. In the event of a spill, one or both of the trays 114 may be removed and discarded, or removed, cleaned, and replaced. Prior to describing the above-mentioned features in detail, other aspects of the radiopharmaceutical heater 110 are described.

The radiopharmaceutical heater 110 includes a body (e.g., housing) 116 that exhibits a generally cuboid (e.g., rectangular prism) shape having a chamfered edge. Accordingly, the body 116 of the heater 110 includes sides 118 and 120, a top 122, a back 124, a front 126, an angled face 128, and a bottom 130. These sides 118, 120 and the front 126 and back 124 may be at a slight angle 132 with respect to the vertical (e.g., near about 5 degrees) to facilitate removal of the body 116 from a fabrication mold. The angled face 128 may be oriented at an angle 134 (with respect to the vertical) that is selected to orient a display 136 toward a technician (e.g., at an angle of between about 20 degrees and about 80 degrees).

The body 116 may be made of any appropriate material (e.g., plastic, composite, ceramic, metal such as aluminum or steel, etc.). In some embodiments, the body 116 of the radiopharmaceutical heater 110 includes radiation-shielding material such as lead, tungsten, tungsten-impregnated plastic, depleted uranium, and combinations thereof. In other embodiments, the body 116 may not include radiation-shielding material, though such material may be located inside the confines of the body 116.

In the illustrated embodiment, the body 116 of the radiopharmaceutical heater 110 includes four fins 138 for supporting the two lids 140 of the heater 110. The fins 138 may be integrally formed with the body 116 (e.g., they may be generally simultaneously cast or injection molded as a single component), or they may be separate components that are fixed to the body 116 in an appropriate manner (e.g., welds, adhesive, mechanical fastener, etc.). The fins 138 extend generally perpendicularly from the top 122 of the body 116, and each fin 138 includes a fillet 142 at its base to reduce stress concentrations. Each of the illustrated fins 138 also has an aperture 144 defined therein for receiving an axle 146 that may utilized to coupled a corresponding one of the lids 140 with the fins 138. Other embodiments may exhibit other appropriate fin designs as well as other appropriate manners of coupling the lids with the fins.

Each of the lids 140 includes a member 148 that extends between the fins 138 and is coupled with the axle 146. Each of the lids 140 also includes a handle 150 and a generally cup-shaped recess 186 that is described below with reference to FIGS. 3 and 4. The handle 150 of each lid 140 extends out from a distal portion of the corresponding lid 140 and includes an aperture 152 to facilitate manipulation of the lid 140. In certain embodiments, the handle 150 may extend from a side of the distal end of the lid 140 to space the handle 150 away from a container 166 in the radiopharmaceutical heater 110. The lids 140 may include radiation-shielding material, such as one or more of those described above, and/or it may include some other material. For instance, in some embodiments, the lid may include a non-radiation-shielded outer shell and a radiation-shielding liner. Other embodiments may exhibit other appropriate lid and/or handle designs.

The body 116 of the radiopharmaceutical heater 110 has an aperture 154 defined therein for receiving an axle 156 that is coupled with one or more of peripheral handles 158. The aperture 154 extends through both sides 118 and 120. Each of the peripheral handles 158 is coupled with a corresponding one of the heater units 112 and may be used to cause a container 166 to be biased against at least a portion of the corresponding heater unit 112 or vise versa. The peripheral handles 158 in the illustrated embodiment are illustrated as levers, but in other embodiments, they may be knobs, buttons, or any other appropriate devices configured to cause a force to be transferred to the axle 156 (e.g., motors, springs, pneumatic devices, and/or other sources of mechanical power). Each of the peripheral handles 158 is shown as having a wider distal portion 160 to facilitate gripping the handle 158 by a technician.

Still referring to FIGS. 1-9, the body 116 of the radiopharmaceutical heater 110 and other components of the heater 110 may be generally symmetric about a plane that bisects the heater 110 generally halfway between the sides 118 and 120 and that is generally parallel to the sides 118 and 120 (e.g., the left half of the heater 110 may generally be a mirror image of the right half of the heater 110). It should be noted, though, that other embodiments may not exhibit this type of symmetry. Some embodiments of the invention may include 3 or more heater units 112, while others may include only a single, solitary heater unit 112.

Figure 2:
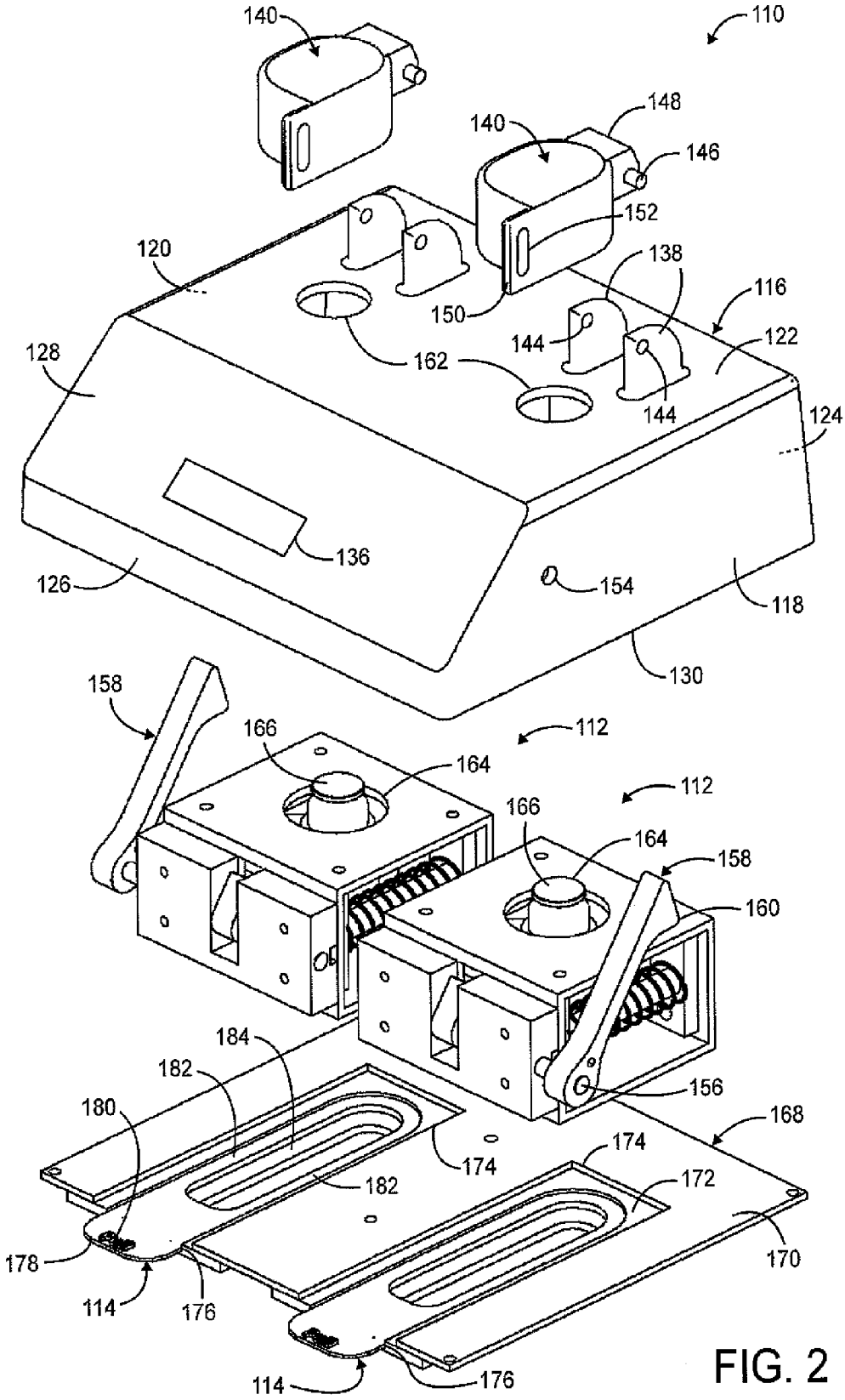
FIGS. 2 and 3 are exploded, perspective views of the radiopharmaceutical heater of FIG. 1.

Referring to FIG. 2, the body 116 of the radiopharmaceutical heater 110 includes apertures 162 for receiving (e.g., accommodating and/or holding) containers 166. Each of these apertures 162 may be generally disposed under a corresponding one of the lids 140, and, as such, the apertures 162 may be substantially (e.g., completely) covered by the lids 140 when the lids 140 are closed. The apertures 162 are shown as being substantially circular; however, other embodiments may include apertures 162 of other shapes. Further, the apertures 162 may exhibit any appropriate size(s). For instance, each of the apertures 162 may be sized according to the largest container 166 expected to be placed therein.

In some embodiments of the radiopharmaceutical heater 110, one or both of the heater units 112 may be modular (e.g., similar in shape and interchangeable). In such embodiments, the heater units 112 may or may not operate independent of one another. The features of the heater units 112 and their operation are described further below with reference to FIGS. 5-9.

Referring to FIGS. 1-4, the bottom 130 of the body 116 is shown as being coupled with to a lower assembly 168 that holds the trays 114 in appropriate positions under the heater units 112 and containers 166. The lower assembly 168 includes a mounting plate 170 and a guide plate 172. The mounting plate 170 includes two generally-rectangular channels 174 that are disposed over the trays 114. The guide plate 172 may be coupled to the bottom of the mounting plate 170, and may include a guide channel 176 that is generally complementary to the shape of the trays 114. In some embodiments, the trays 114 may rest on the guide channels 176. Some embodiments may exhibit other appropriate designs of the lower assembly 168 and/or components thereof.

Figure 3:
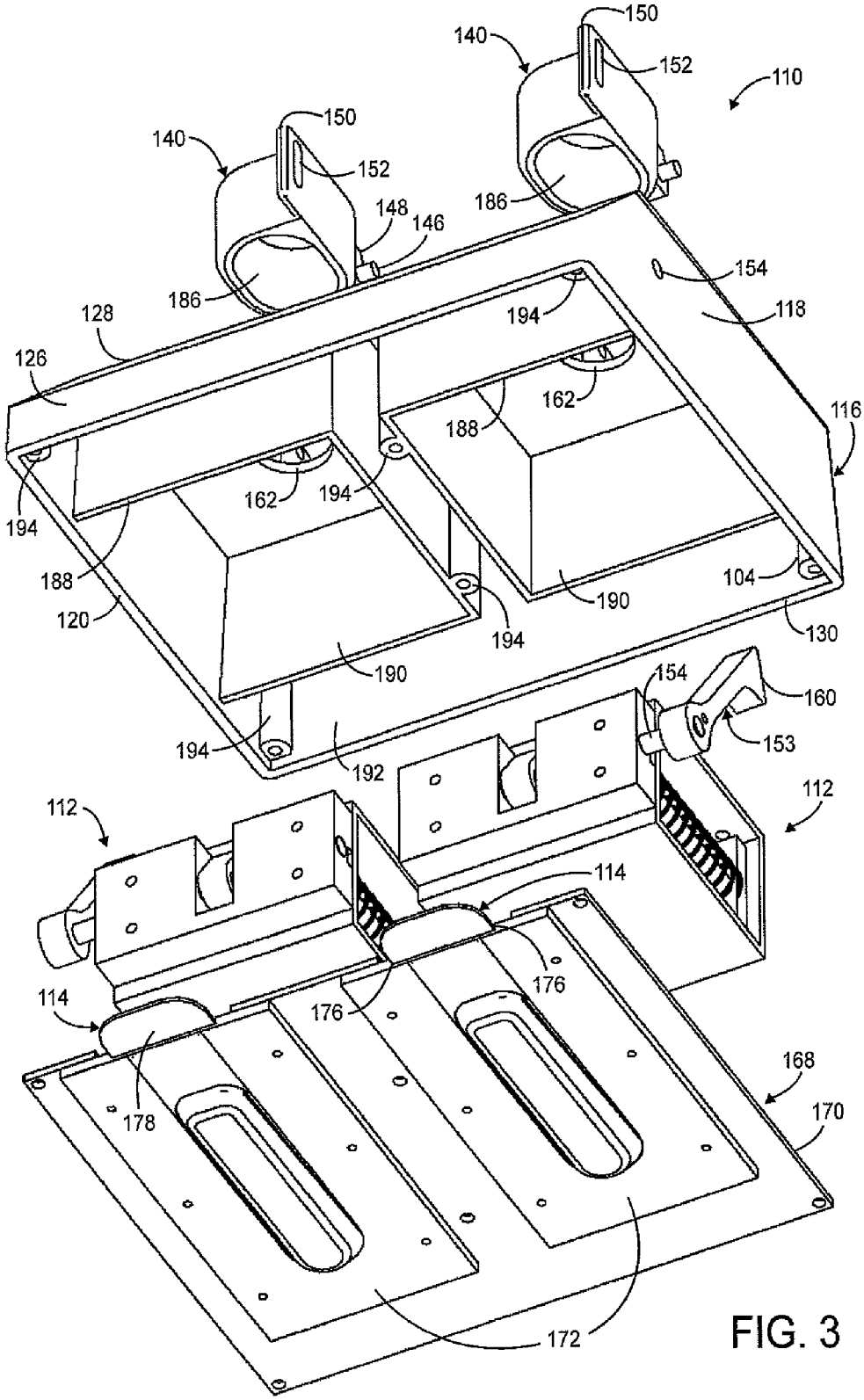
Figure 4:
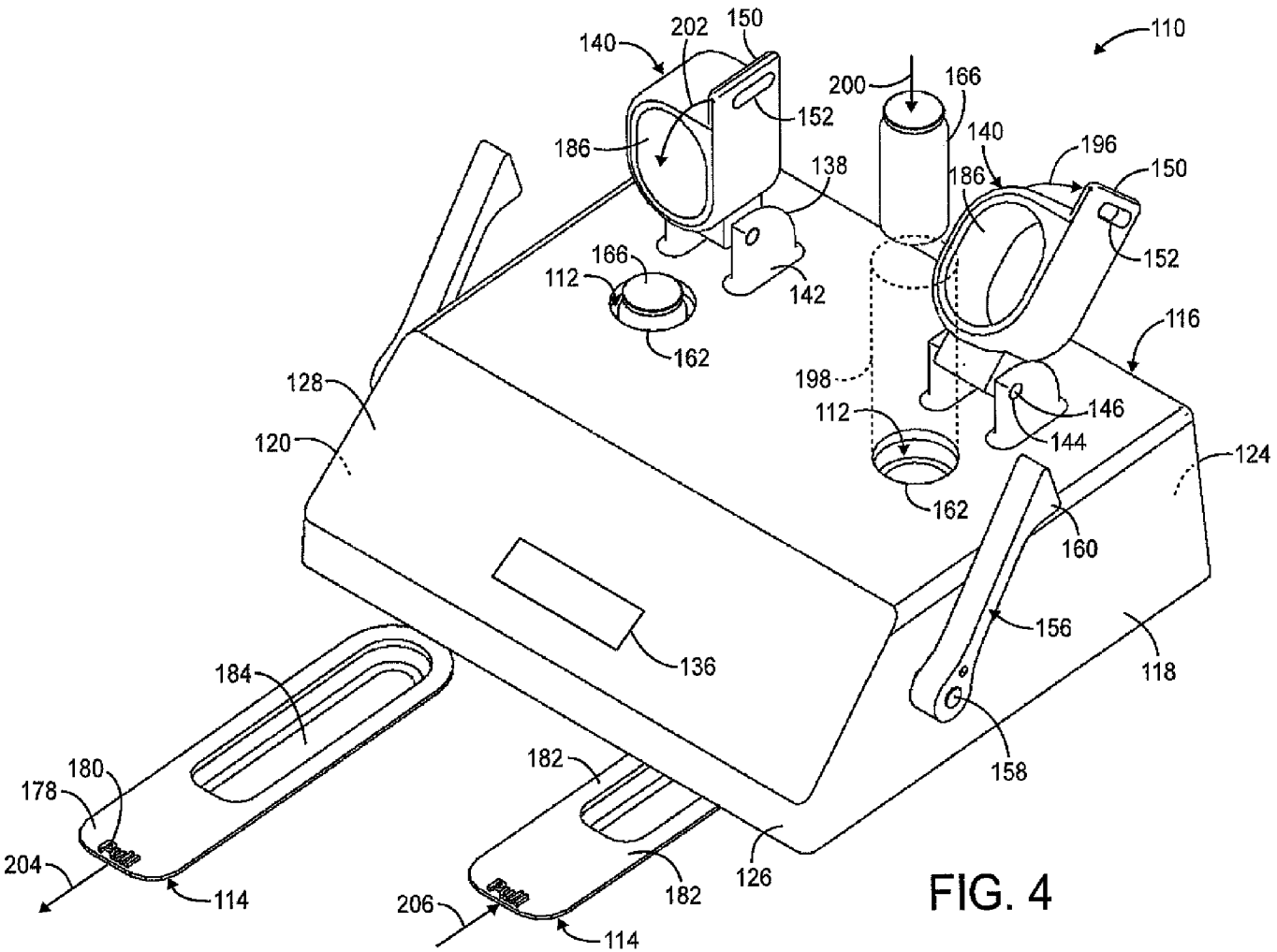
FIG. 4 is a perspective view of the heater of FIG. 1 illustrating aspects of its operation.

Referring to FIGS. 2-4, each of the trays 114 is shown as having a handle 178 that includes an appropriate grip 180. In addition, each tray 114 includes generally planar slide rails 182 and has a reservoir 184 defined therein. The trays 114 may be manufactured in any appropriate manner (e.g., injection molded, vacuum formed, stamped, etc.) using any appropriate material (e.g., plastic, metal, etc.). The reservoir 184 may be positioned generally under the container 166 and/or under an expected flow path for a fluid leaving the container 166. In some embodiments, the volume of the reservoir 184 may be as large as or even larger than the volume of fluid expected to be in the container 166. The reservoir 184 may, in some embodiments, include an appropriate absorbent medium (e.g., sponge, guar gum, desiccant such as silica gel, or a combination thereof).

As illustrated in FIG. 3, the lids 140 may include cup-shaped recesses 186 that overlap at least a portion of each of the containers 166 when the containers are located within the apertures 164 and the lids 140 are closed. In other words, when a given lid 140 is closed, a portion of a respective container 166 may be located within the cup-shaped recess 186 of the lid 140. In the illustrated embodiment, the recesses 186 are generally oval right cylinders. Other embodiments may exhibit other appropriate recess shapes, and even other embodiments may include lids that are devoid of recesses 186.

Referring to FIG. 3, interior walls 188 of the body 116 divide the interior of the body 116 into inner volumes 190 and an outer volume 192. In some embodiments, the interior walls 188 include radiation shielding material such as any of those described herein. Each of the inner volumes 190 may be separated from the other and may be shaped to receive and house a heater unit 112. In some embodiments, the inner volumes 190 may define a generally cuboid volume. The interior of the body 116 may include a plurality of threaded mounts 194 for securing the body 116 to the lower assembly 168. In some embodiments, the threaded mounts 194 and the interior walls 188 may be recessed slightly below the bottom 130 of the body 116 to position all or part of the lower assembly 168 above the bottom 130. The interior walls 188 and the threaded mounts 194 may be integrally formed with the rest of the body 116. In some embodiments, feet may be attached to the bottom of the lower assembly 168 to support the heater 110 and space the bottom of the trays 114 above the surface upon which the heater 110 rests. Some embodiments may exhibit other appropriate designs of the interior of the body 116.

FIG. 4 illustrates the operation of the trays 114 and the lids 140. The lids 140 may be opened by rotating each lid 140 about the axis 146, as illustrated by arrow 196. Each lid 140 may be rotated by grasping the handle 150, either directly or with forceps or some other device, and lifting upwards away from the body 116. In some embodiments, the forceps (or other appropriate tool) may be inserted into the aperture 152 to assist in enabling a technician to raise the lid 140. This design of the handle 150 may be said by some to help protect technicians from undesired radiation exposure. During movement of the lids 140, the handle 150 may not pass directly over the corresponding aperture 162. This is believed by some to make it easier to operate the lids 140 while avoiding exposure to radiation emitted from the containers 166. In particular, the handle 150 is designed such that it avoids travel though the region illustrated by the imaginary dashed cylinder 198, which has a diameter that generally corresponds to a diameter of one or both the aperture 162 and the aperture 164.

Still referring to FIG. 4, when a given lid 140 is open, the container 166 may be passed through the corresponding aperture 162 and placed into the corresponding heater unit 112 of the radiopharmaceutical heater 110. The container 166 may be moved downward with forceps or other appropriate tool, as illustrated by arrow 200, through the apertures 162, 164 and into the heater unit 112. The lid 140 may then be closed by pivoting the lid 140 in the opposite direction about the axis 146 toward the body 116, as illustrated by arrow 202. A process for using the radiopharmaceutical heater 110 in radiopharmaceutical preparation is described below with reference to FIG. 19.

Still referring to FIGS. 1-4, one or both of the spill trays 114 may be partially or entirely removed to check for a spill and/or clean the radiopharmaceutical heater 110 (e.g., after a spill). To operate a spill tray 114, a technician may pull on the grip 180 and slide the tray 114 out from under the heater 110, as illustrated by arrow 204. The technician may then inspect the reservoir 184 of the spill tray 114 for fluid that has escaped from the container 166. In some embodiments, the radiopharmaceutical heater 110 may include a leak detector having a sensor positioned in the reservoir 184. For example, a circuit may monitor the resistance between two electrical leads disposed in the reservoir 184. If the resistance drops due to fluid shorting between the leads, the heater 110 may signal a technician through the display 136 or some other audible and/or visual alarm. In the event of a spill, the tray 114 may be either cleaned and placed back in the heater 110 or discarded and replaced with a new tray 114 (e.g., in the case that that tray is designed to be disposable). To replace or return the tray 114, the guide rails 182 of the spill tray 114 may be placed into the guide channels 176 of the guide plate 172 (FIG. 2), and the tray 114 may be pushed under the heater 110, as illustrated by arrow 206. Having a predefined, easily-removable receptacle for spilled fluid, such as the tray 114, is believed by some to facilitate efficient and effective cleaning of the heater 110 after a spill.

Figure 5:
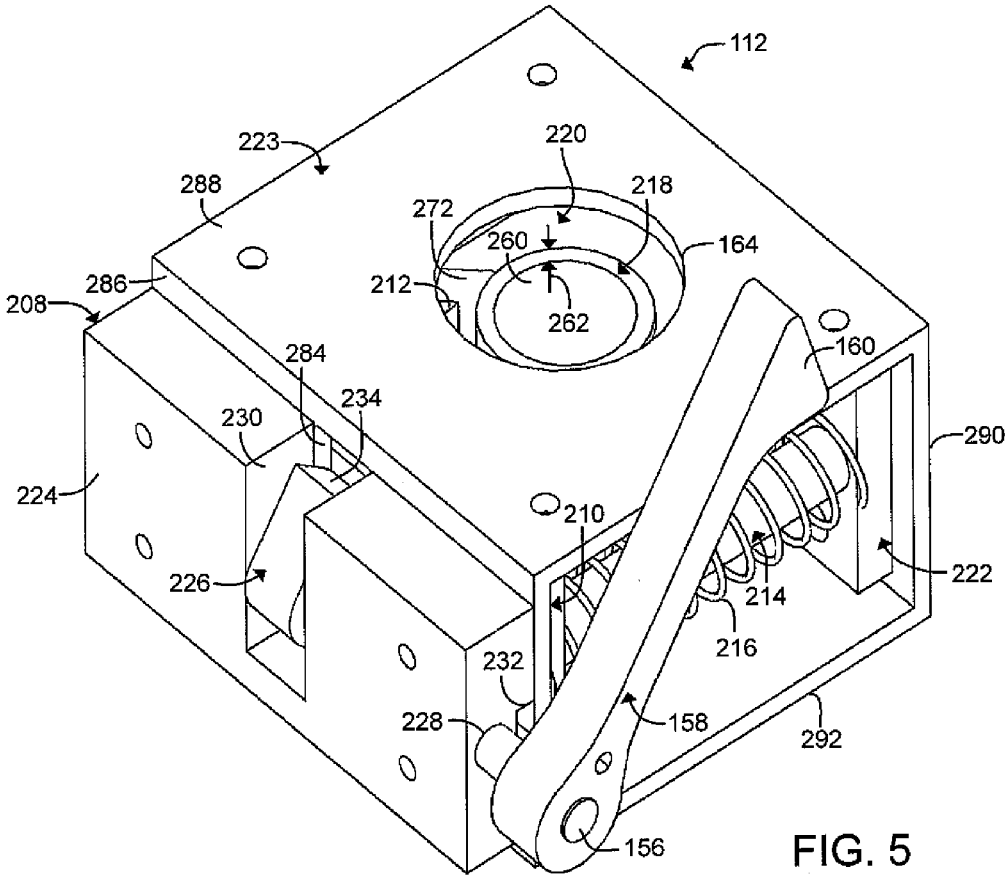
FIG. 5 is a perspective view of a heater unit of the radiopharmaceutical heater shown in FIG. 1.
Figure 6:
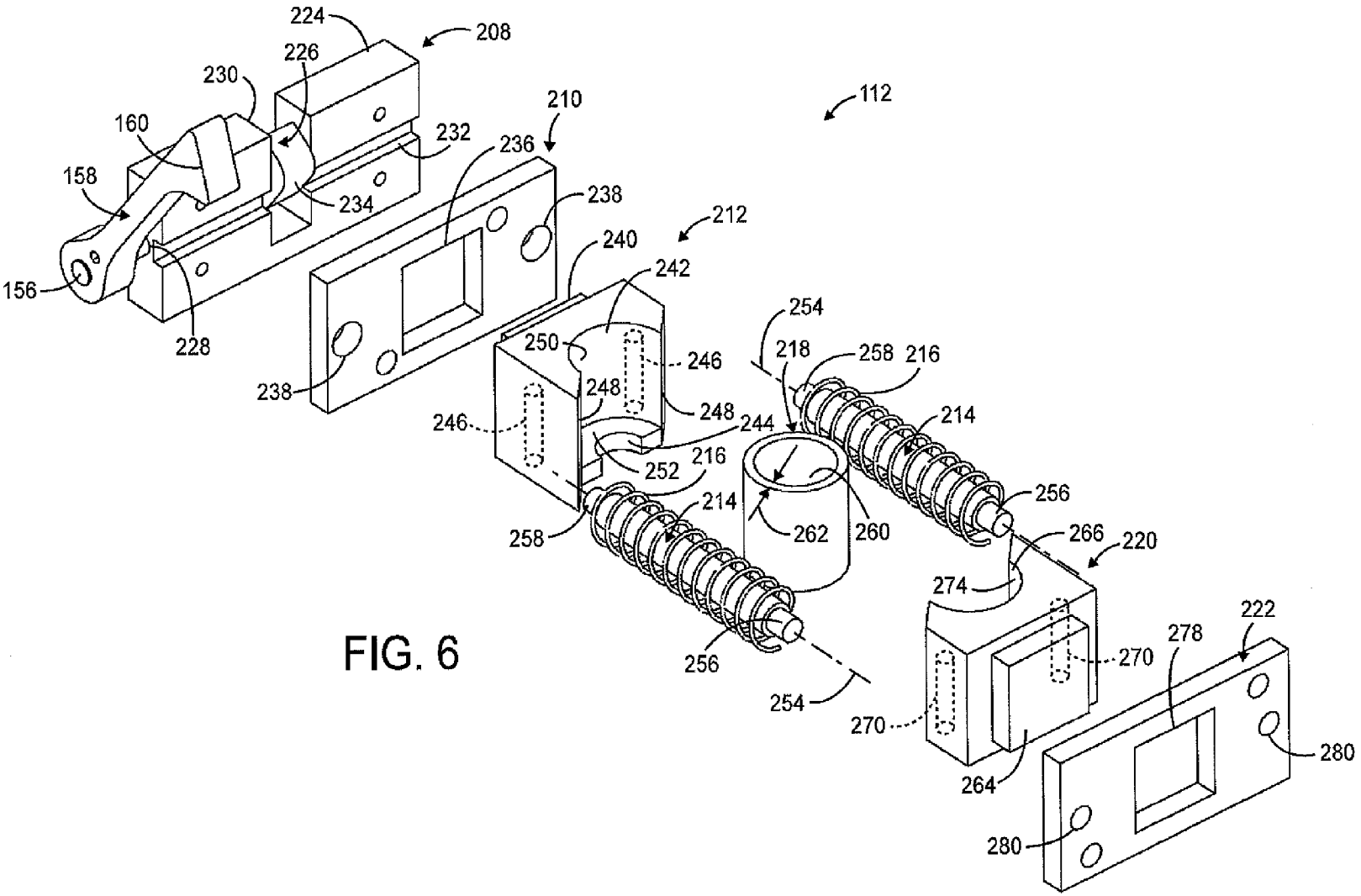
FIGS. 6 and 7 are exploded, perspective views of the heater unit of FIG. 5.
Figure 7:
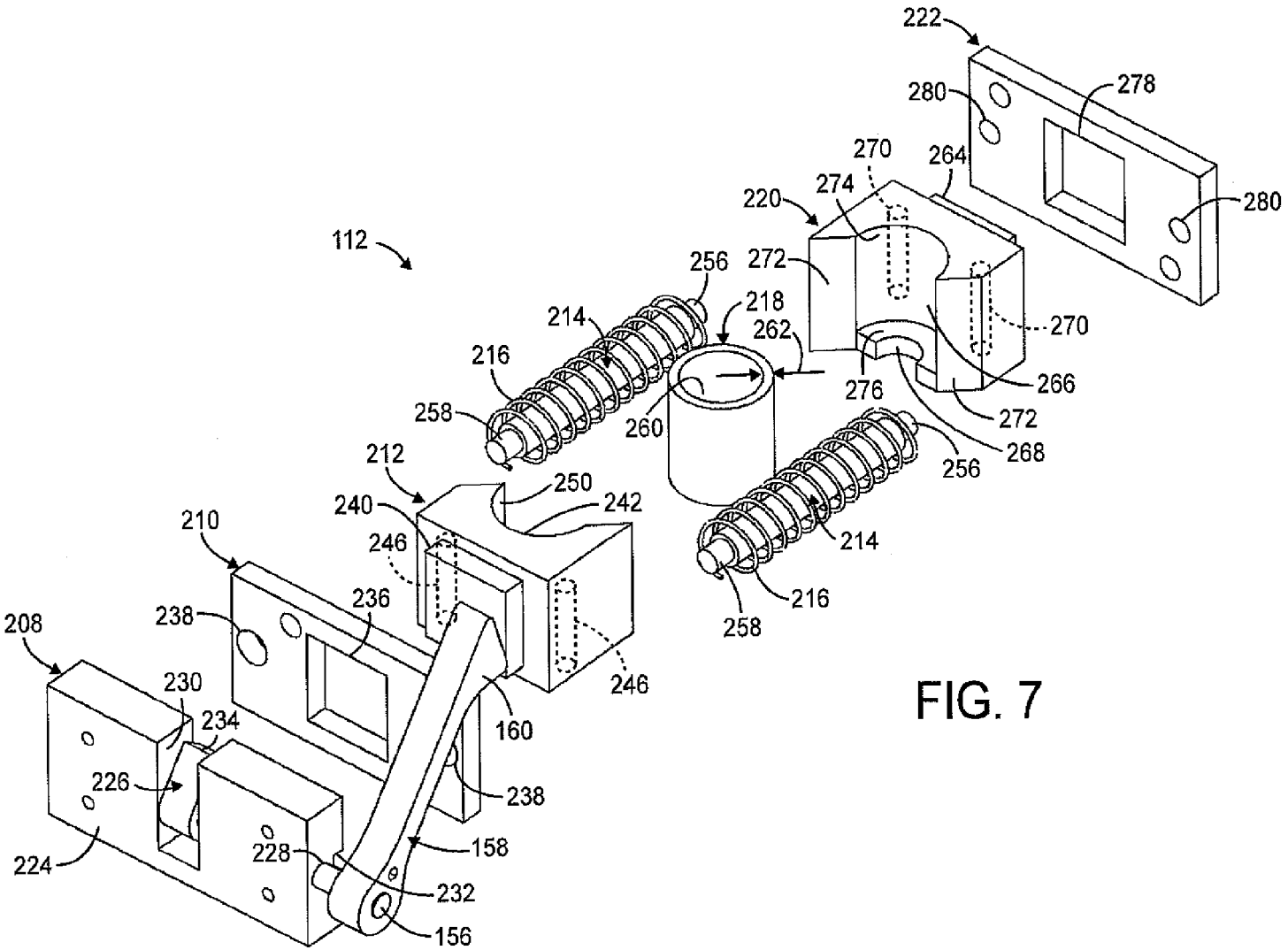

FIGS. 5-7 illustrate one of the heater units 112 in greater detail. It should be noted that the description of the heater unit 112 references all three of these figures at various points, as some details of the heater unit 112 are visible in some of FIGS. 5-7 but not in others. The illustrated heater unit 112 includes an actuator 208, a movable backer plate 210, a movable heater block 212, guide rods 214, springs 216, a compliant heat-transfer member 218 (sometimes referred to herein as the "CHT member"), a static heater block 220, a static backer plate 222, and a frame 223.

Referring to FIG. 6, the actuator 208 is shown as having the previously mentioned axle 156 and handle 158. Additionally, the actuator 208 includes a mounting block 224 and a cam 226. The illustrated mounting block 224 has an aperture 228 defined therein that accommodates the axle 156 and allows the axle 156 to rotate therewithin. In some embodiments, the aperture 228 extends through the entire length of the mounting block 224. The mounting block 224 also includes a vertical channel 230, in which the cam 226 is disposed, and a horizontal channel 232 for receiving the ends of the guide rods 214. The illustrated cam 226 couples at one end to the axle 156, and, at the other end, the cam 226 includes a cam surface 234, which may be curved or angled. The illustrated actuator 208 may be referred to as a manually-operated actuator. Other embodiments may include other types of manually-operated actuators or powered actuators. For example, in some embodiments, the cam 226 may be moved (e.g., rotated) using an electric motor, pneumatic power, piezoelectric motor, or other mechanism capable of providing mechanical energy.

Referring to FIGS. 6-7, the movable backer plate 210 includes a block mount 236 and two apertures 238. The block mount 236 exhibits a generally rectangular (e.g., generally square) shape and a generally cuboid volume. However, in other embodiments, it may exhibit other appropriate shapes and/or volumes. While this block mount 236 is generally designed to at least assist in securing the movable backer plate 210 to the heater block 212, other embodiments may include other appropriate features designed to at least assist in securing the movable backer plate 210 to the heater block 212. The apertures 238 may be generally complementary to the guide rods 214 and may be sized to allow the movable backer plate 210 to slide along the guide rods 214. In other embodiments, the apertures 238 may have some other shape, such as a channel cut into the sides of the movable backer plate 210. The moveable backer plate may be made of a plastic, such as a phenolic material, or other appropriate material(s).

The movable heater block 212 may include a mounting protrusion 240, a container receptacle 242, a drainage aperture 244, heating elements 246, and mating surfaces 248. The heater block 212 may include (e.g., be made of) radiation-shielding material, such as lead, tungsten, tungsten-impregnated plastic, depleted uranium, or any combination thereof. In some embodiments, the heater block 212 may include a combination of radiation-shielding materials and other materials selected for their thermal conductivity. For example, the heater block 212 may include an inner portion that houses the heating elements 246 and forms the container receptacle 246. This inner portion may be formed of a material with a relatively high thermal conductivity (e.g., copper or aluminum), and the outer portion of the heater block 212 may surround the inner portion and include a radiation-shielding material, such as one of the materials mentioned herein. In other embodiments, the heater block 212 may be formed substantially or entirely from a material having a high thermal conductivity (e.g., a material with a thermal conductivity greater than 100 W/(mK)).

The mounting protrusion 240 of the heater block 212 may be generally complementary to the block mount 236 on the movable backer plate 210. In some embodiments, the mounting protrusion 240 may be sized to form an interference fit within the block mount 236, thereby securing the moveable backer plate 210 to the moveable heater block 212. In other embodiments, these components may be secured by other means (e.g., threaded connection, adhesive, or they may be integrally formed).

The container receptacle 242 of the heater block 212 may define approximately one half of a generally right-circular-cylindrical volume. A heat conducting surface 250 (e.g., a surface through which a substantial amount or nearly all of the heat flowing to the container 166 from the heater block 212 flows) may form the boundary of the container receptacle 242. The drainage aperture 244 of the heater block 212 may define approximately one half of a generally right-circular-cylindrical volume that is generally concentric with the container receptacle 242. As shown, this aperture 244 may extend through a bottom surface 252 of the container receptacle 242.

The heating elements 246 of the heater block 212 may be resistive heating elements, Peltier heating elements, induction heating elements, fluid-to-solid heat exchangers, fluid-to-fluid heat exchangers, or other type(s) of heating elements configured to deliver heat energy to the heating block 212. The illustrated embodiment includes two heating elements 246 that are accessible from the bottom of the heater block 212 and are modular (e.g., of generally uniform shape and size). Other embodiments may include more or fewer heating elements or heating elements exhibiting different orientations. For instance, in some embodiments, each heater block 212 and 220 may include one heating element that extends generally horizontally and is accessible from a side of the heater block 212 or 220. In some embodiments, the heating elements 246 may be one-inch (25.4 mm) 50 watt cartridge heaters that are powered by 110 volts AC.

The mating surfaces 248 of the heater block 212 may be configured to obstruct the path of radiation leaving the container 166. To this end, the surfaces 248 may be generally complementary to mating surfaces on the static heater block 220, and they may be angled away from the interior of the CHT member 218. In some embodiments, the mating surfaces 248 may include multiple angles, teeth, overlapping members, or bends, to form a tortuous path.

Each of the guide rods 214 of the heater unit 112 may have a generally right-circular-cylindrical shape that is generally concentric about a corresponding axis 254. Each of these guide rods 214 may have a generally uniform cross-sectional shape along their length, and they may include narrower mounting portions 256, 258 at their ends for securing the guide rods 214 to the static backer plate 222 and the actuator 208. The illustrated embodiment includes two guide rods 214, but other embodiments may include more or fewer guide rods or other structures shaped to guide movement of the moveable heater block 212.

The springs 216 of the heater unit 112 are helical compression springs that are sized to fit concentrically about the guide rods 214. As explained below, the springs 216 may bias the heater blocks 212 and 220 away from one another and counteract forces applied by the cam 226. In other embodiments, these forces may be counteracted with other devices, such as tension springs disposed on the other side of the movable backer plate 210, pneumatic devices, magnets, and/or electric motors.

The CHT member 218 of the heater unit 112 may have a generally circular-tubular shape that is generally complementary to the shape of the container receptacle 242 (FIG. 6) and the heater block 212. The CHT member 218 may have an interior 260 that defines a generally right-circular-cylindrical volume, and it may be made of or include, nylon, a thermally-conductive fabric, a silicone gel or film, a PTFE (poly-tetra-flouroethane, e.g., Teflon™) member, which may include a filler such as glass fiber, carbon, graphite, molybdenum disulphide, or bronze, or other appropriate material(s). The CHT member 218 may include any appropriate materials including, but not limited to solids, powders, liquids, and gels. For instance, the CHT member 218 may include a volume of a fluid (e.g., water) in a sealed, flexible container, such as a plastic packet, that flexes to accommodate a container 166. In another example, the CHT member may include or be made of a silicone core that may be compliant and a PTFE exterior that may be wear resistant. The CHI member 218 may include a material selected based on its ability to conform to the shape of a container 166. In some embodiments, the material may have a Young's modulus less than 10, 5, 1, or 0.5 GPa. Further, the CHT member may have a thermal conductivity greater than 0.5, 1, 3, or 4 BTU-in/ft$^2$-hr-degree F. The CHT member 218 may have a thickness 262 that is generally uniform, or the thickness may vary. In some embodiments, the CHT member 218 may be a single piece or several separate pieces. As explained below, the CHT member 218 may function as an intermediary between the heater blocks 212 and 220 and the container 166. The CHT member 218 may conform to the shape of the container 166, accommodating variations in the dimensions of the container 166. In other words, the CHT member 218 may vary its dimensions (e.g., curvature, volume, and other geometric properties) to completely or substantially match the shape of part (e.g., a majority or a substantially entirety) of an outer surface of the container 166. This is believed to increase the surface area of the container 166 through which heat is transferred. In some embodiments, the CHT member 218 may contact part, a majority, or a substantially entirety of the outer surface of the container 166 within the heater blocks 212 and 220. In other embodiments, the CHT member 218, like many of the other features described herein, may be omitted, and the heater blocks 212 and 220 may make direct contact with the container 166.

The static heater block 220 of the heater unit 112 includes a mounting protrusion 264, a container receptacle 266, a drainage aperture 268, heating elements 270, and mating surfaces 272. The static heater block 220 may be generally rotationally symmetric to (e.g., generally the same as but oriented in the opposite direction) the movable heater block 212. As such, the various components of the static heater block 220 having names like the components of the movable heater block 212 are similar (e.g., virtually identical) unless otherwise noted. The container receptacle 266 may be generally defined by a heat conducting surface 274 that is generally complementary to the CHT member 218. A bottom surface 276 may support the container 166 and the CHT member 218. The static heater block 220 may be made of or include the same material or materials as the movable heat transfer block 212 or it may be made of different materials. The heating elements 270 may include any of the heating elements discussed above with reference to the heating elements 246.

In the illustrated embodiment, the static backer plate 222 of the heater unit 112 may include a block mount 278 and apertures 280. The block mount 278 may be sized to form an interference fit with the mounting protrusion 264 on the static heater block 220 and secure the static heater block 220 to the static backer plate 222. In other embodiments, these features 222 and 220 may be coupled to one another with other devices, or are they may be integrally formed as a single component. The apertures 280 may be generally complementary to the mounting portions 256 of the guide rods 214, and they may cooperate with the mounting portions 256 to secure the guide rods 214 to the static backer plate 222. In some embodiments, the apertures 280 may be smaller than the apertures 238 on the movable backer plate 210 to prevent the static backer plate 222 from moving relative to the guide rods 214. The apertures 280 may, in certain embodiments, include an adhesive, threads, or other appropriate device, to secure the static backer plate 222 to the guide rods 214.

An example of the frame 223 is illustrated by FIG. 5. In some embodiments, the frame 223 includes aperture 164 and a side aperture 284. The top aperture 164 may be generally circular and may be sized to allow the container 166 to pass through. The side aperture 284 may be generally rectangular, and it may allow the cam 226 to pass through and contact the movable backer plate 210 and/or the movable heater block 212. In some embodiments, the frame 223 may include an aperture sized and positioned to allow the mounting protrusions 258 of the guide rods 214 to extend into the horizontal channel 232 of the actuator 208. The illustrated frame 223 effectively has four sides 286, 288, 290, and 292 that define a generally cuboid volume, but in other embodiments, the frame 223 may have more or fewer sides and may have a different shape.

Figure 8:
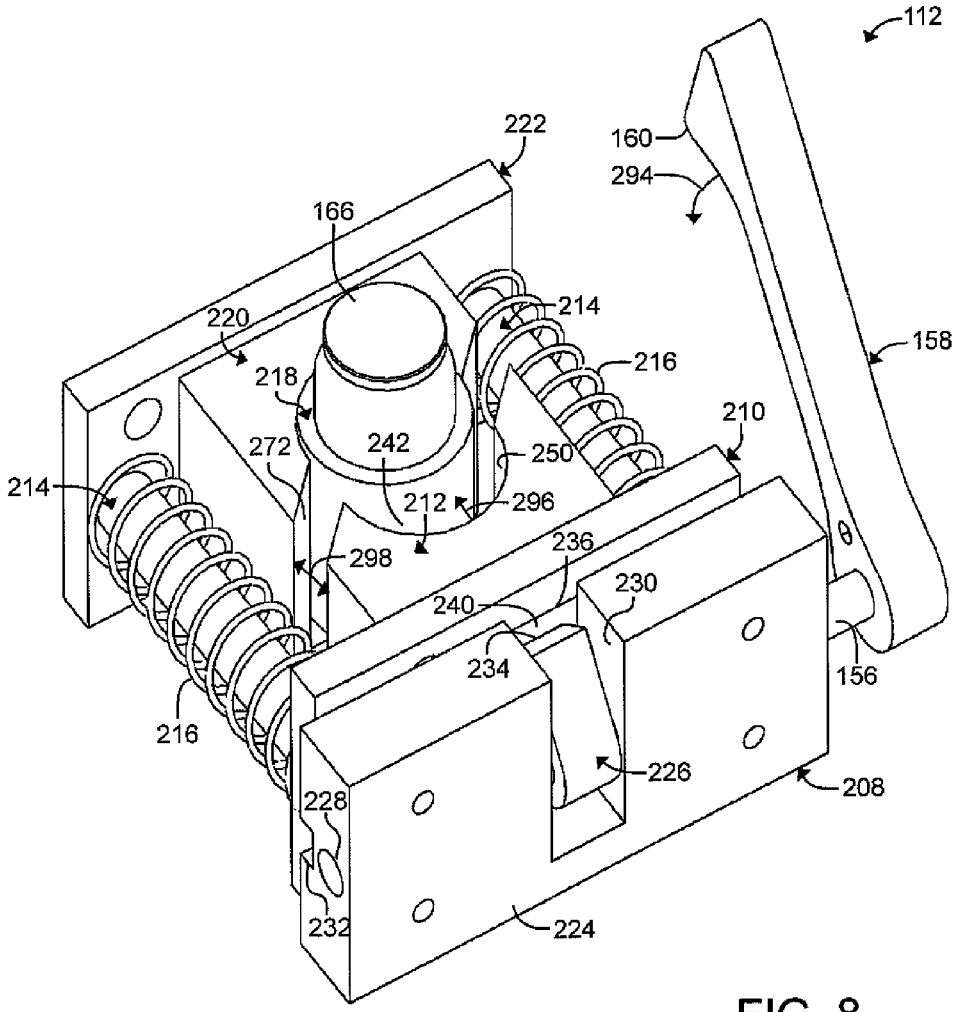
FIGS. 8 and 9 are perspective views of the heater unit of FIG. 5 illustrating aspects of its operation.
Figure 9:
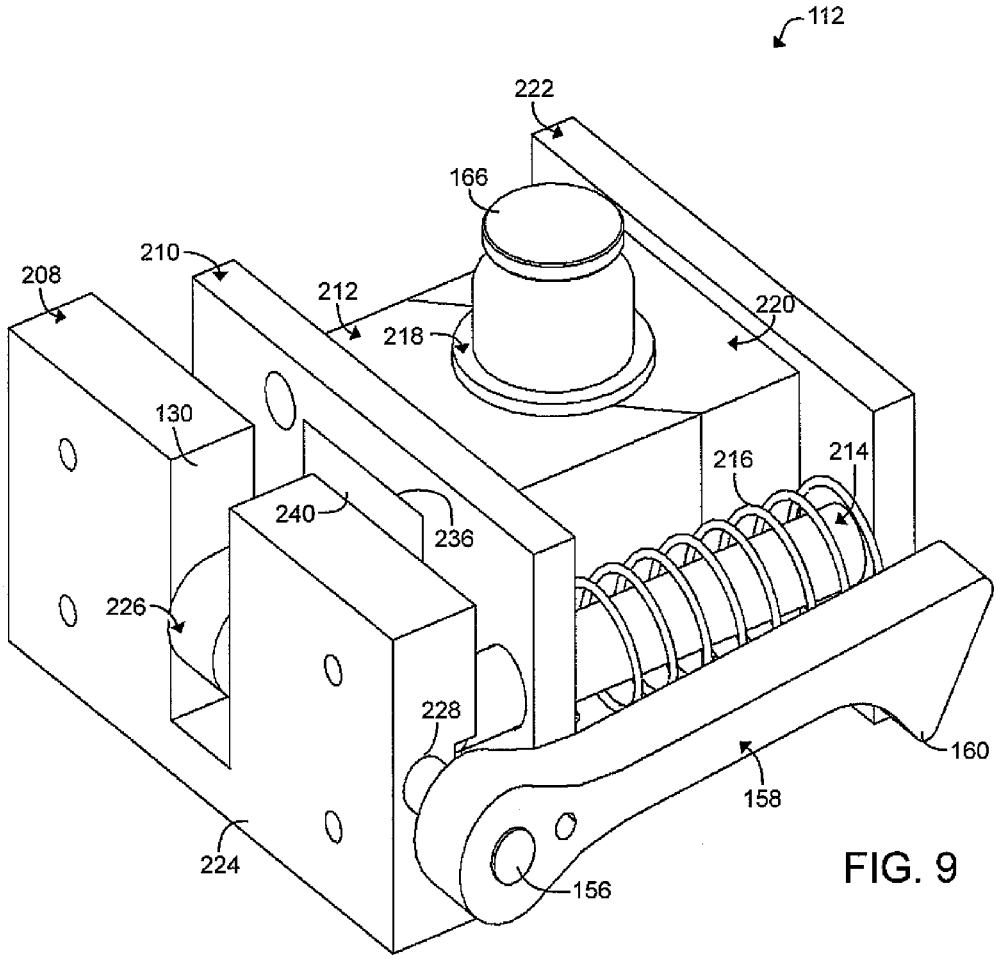

FIGS. 8-9 illustrate operational aspects of the heater unit 112. FIG. 8 depicts the container 166 placed in the CHT member 218, and FIG. 9 depicts the container 166 biased against the CHT member 218 and the heater blocks 212 and 220. As used herein, an object is said to be "biased against" or "biased by" another object if a force from one object is transmitted to the other object, notwithstanding intermediary members, such as, in this example, the CHT member 218.

To reach the state illustrated by FIG. 8, which is an example of an open position for the heater unit 112, the container 166 may pass through the aperture 162 in the body 116 (FIG. 2) and the aperture 164 in the frame 223 (FIG. 5). Once in the position illustrated by FIG. 8, the container 166 may be biased against the CHT member 218 by the movable heater block 212. The heater block 212 may be moved by rotating the handle 158, as illustrated by arrow 294, so that the heater block 212 biases the container 166. The handle 158, as it rotates, may rotate the axle 156, which may rotate the cam 226 at generally the same angular velocity as the handle 158. As the cam 226 rotates, the contact surface 234 may rotate through the aperture 284 in the frame 223 (FIG. 5) and push against the mounting protrusion 240 (FIG. 8) of the movable heater block 212 or other parts of the moveable backer plate 210. The force from the cam 226 may move the movable heater block 212, as indicated by arrow 296, through some distance 298 which may be greater than, less than, or generally equal to 1 mm, 2 mm, 5 mm, 1 cm, 2 cm, or 4 cm. In some embodiments, the movable heater block 212 may move until its mating surface 248 contacts the mating surface 272 of the static heater block 220. In other embodiments, though, the surfaces 272 and 248 may not necessarily contact one another. Movement of the movable heater block 212 may cause the heat conducting surfaces 250 and 274 of the heater blocks 212 and 222 to compress the CHT member 218 against the container 166. This compressive force may increase the amount of surface area over which the CHT member 218 contacts both the container 166 and the heater blocks 212 and 220, thereby potentially enhancing heat transfer into the container 166. In other words, the compressive force may cause the CHT member 218 to change shape and contact a greater surface area of the container 166.

FIG. 9 illustrates the heater unit 112 in a closed position, with the CHT member 218 biased against the container 166 by the heater blocks 212 and 220. To raise or maintain the temperature of the heater blocks 212 and 220, the heating elements 270 and 246 may deliver heat energy to the heater blocks 212 and 220, and the heater blocks 212 and 220 may conduct heat across their heat conducting surfaces 250 and 274, through the CHT member 218, and into the container 166. In some embodiments, the heating elements 270 and 246 may preheat the heater blocks 220 and 212 before the container 166 is placed in the CHT member 218 to speed heating.

In some embodiments, biasing the CHT member 218 against the container 166 may result in a relatively fast rate of heat transfer. In certain embodiments, the container 166 may be heated from a starting temperature, such as room temperature or a recommended storage temperature for a radiopharmaceutical in the container 166 (e.g., between 15 and 25 degrees Celsius) to a target temperature (e.g., between 95 and 98 degrees Celsius, or greater than or generally equal to 105 degrees Celsius, 115 degrees Celsius, or 120 degrees Celsius) in less than 15 minutes, less than 10 minutes, less than 8 minutes, less than 6 minutes, or less than 4 minutes. The heater unit 112 may, in some instances, maintain a temperature of the container 166 within plus or minus 2 degrees Celsius of the target temperature using a controller than cycles the heating elements 246 and 270 on and off. The volume of radiopharmaceutical in the container 166 may be greater than, less than, or generally equal to 10 mL, 30 mL, 50 mL, 100 mL, or 150 mL.

After a period of time, the container 166 may be removed from the heater unit 112. To remove the container 166, the handle 158 may be rotated from the position illustrated by FIG. 9 back to the position illustrated by FIG. 8, and the springs 216 may drive the movable heater block 212 and movable backer plate 210 away from the container 166. As the movable backer plate 210 moves, the apertures 238 may slide over the guide rods 214. This may un-bias the container 166, such that the container 166 may be removed from the CHT member of the heater unit 112.

The illustrated heater blocks 212 and 220 are biased away from one another by the springs 216, and the actuator 208 overcomes the springs 216 to move the heater blocks 212 and 222 toward one another. In other embodiments, these roles may be reversed, and a spring or other device may bias the heater blocks 212 and 220 against the container, while an actuator pushes the heater blocks 212 and 220 away from the container 166.

During the process of biasing the container 166, the heater blocks 212 and 220 may be characterized as moving relative to one another with a single degree of freedom. In this embodiment, the position and the orientation of heater block 212 may be described relative to the heater block 220 with a single variable: the distance 298. In this example, once the distance 298 is known, the relative orientation and position of the heater blocks 220 and 212 are substantially or completely known (e.g., can be calculated), as the guide rods 214 may generally confine the heater block 212 to moving in a single direction, without rotation.

Figure 10:
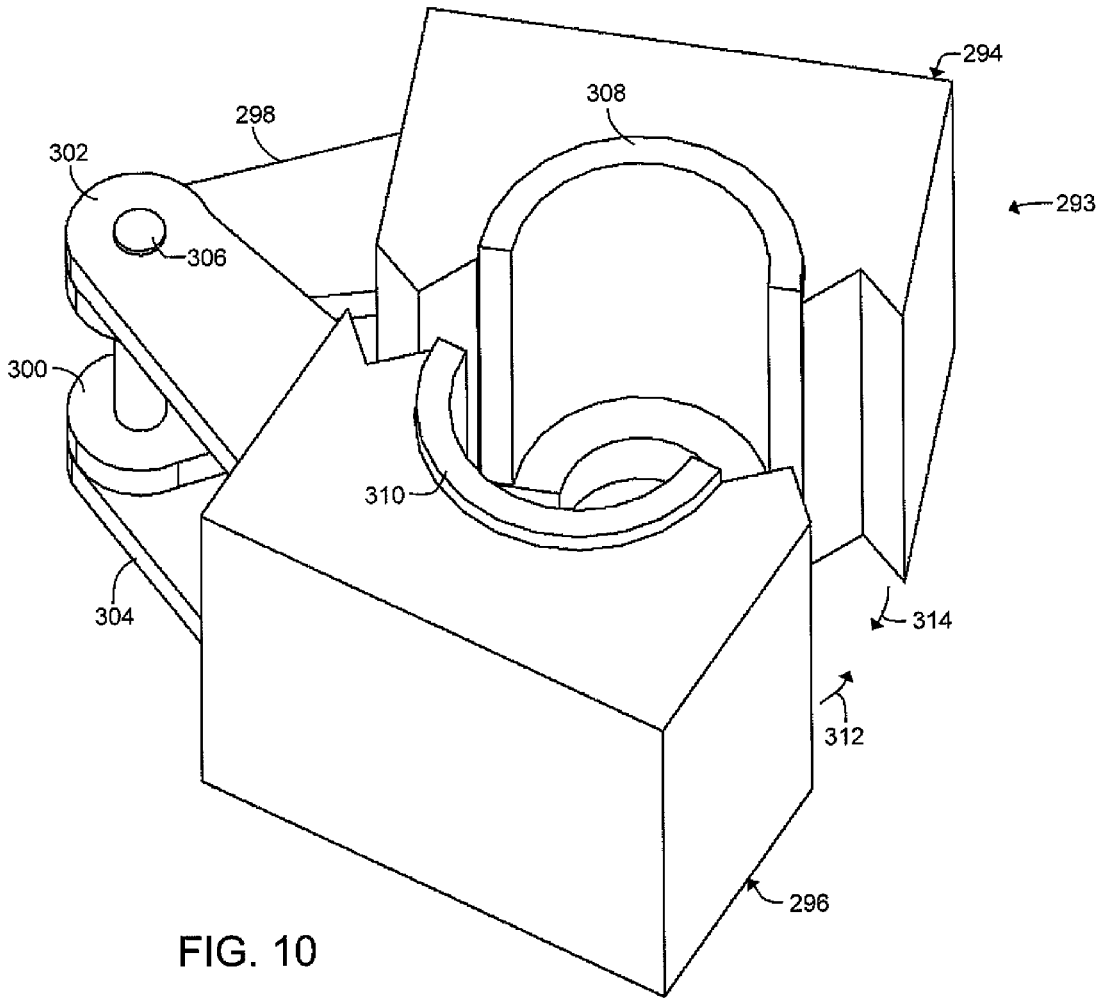
FIGS. 10 and 11 are perspective views of another heater unit.
Figure 11:
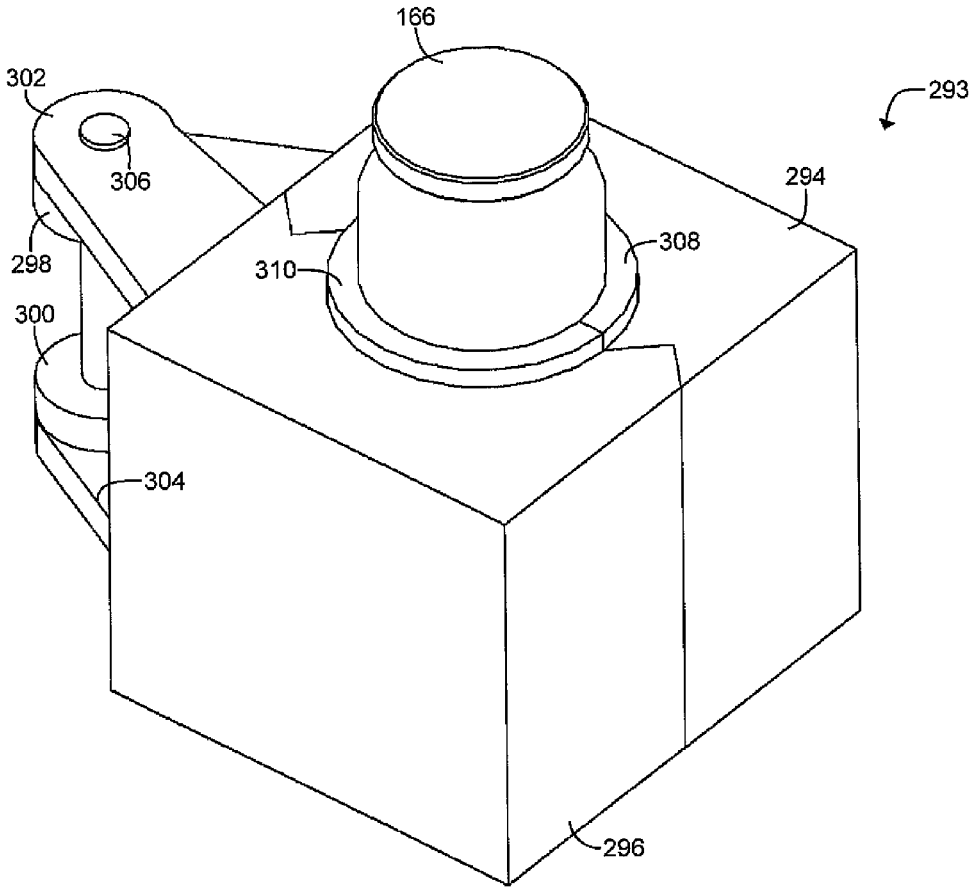

Other embodiments may include heater blocks configured to move relative to one another with a single degree of freedom in other ways. For example, FIGS. 10-11 illustrated another example of a heater unit 293 with heater blocks 294 and 296 that may be configured to move with a single degree of freedom relative to one another. The heater block 294 may include arms 298 and 300 that are linked to arms 302 and 304 of the heater block 296 by an axle 306. As illustrated by comparing FIG. 10 and FIG. 11, which depict the heater unit 293 opened and closed, a container 166 may be biased against CHT members 308 and 310 by pivoting one or both of the heater blocks 294, 296 about the axle 306 toward one another, as illustrated by arrows 312, 314. In this example, the single degree of freedom between the heater blocks 294, 296 is their angular position as they pivot about a single axis (i.e., axle 302) such that the heater blocks 294, 296 are not free to move about or along other axes. To open the heater unit 293, one or both of the heater blocks 294, 296 can be pivoted about the axle 302 in a direction substantially opposite to the corresponding arrow(s) 312, 314.

Still other embodiments may include heater blocks configured to move in other ways. For example, in some embodiments, the heater blocks may be configured to slide against one another or pivot about some other axis (e.g., an axis disposed underneath the heater blocks). In some embodiments, the heater blocks may have more than one degree of freedom relative to each other (e.g., two or more degrees of freedom, or three or more degrees of freedom). In other embodiments, there may be a static heater block, and some other component may bias the container 166. An example of such a system having a generally static heater block and other moving parts is described below with reference to the FIGS. 12-18.

Figure 12:
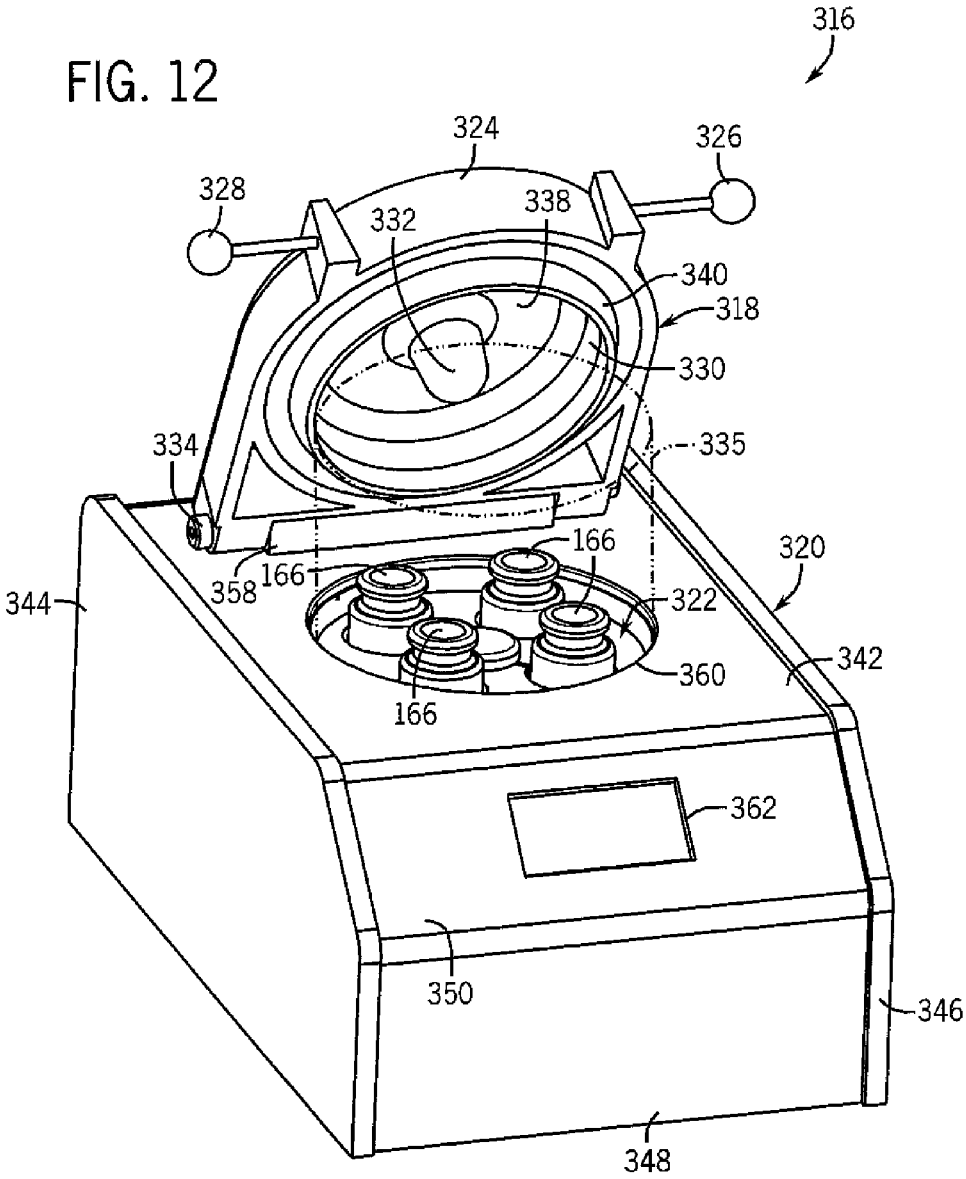
FIGS. 12-14 are perspective views of another radiopharmaceutical heater.
Figure 13:
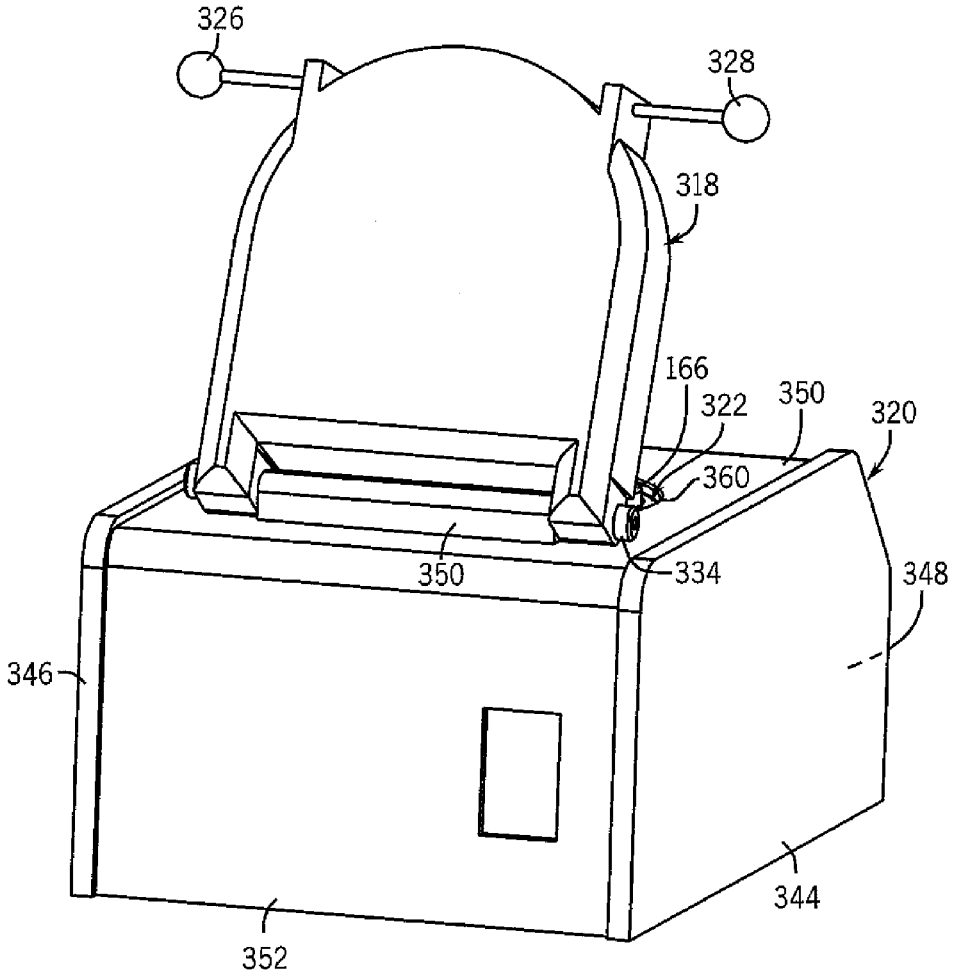
Figure 14:
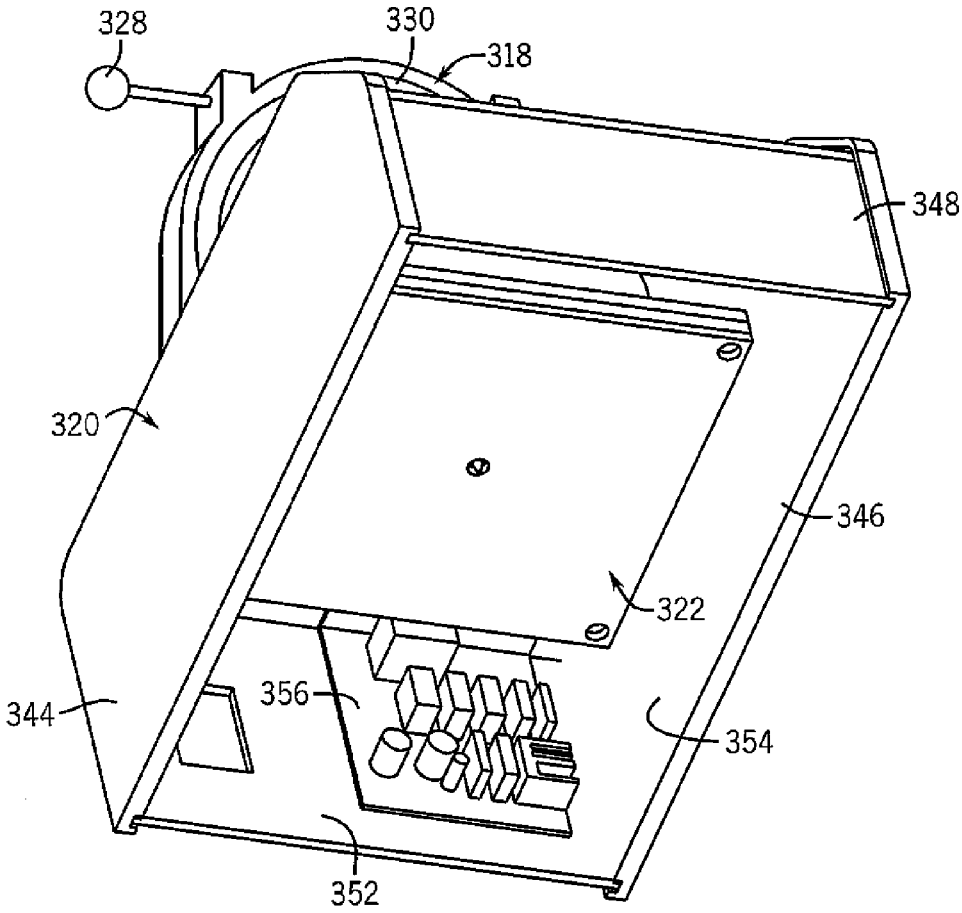

FIGS. 12-14 illustrate another example of a radiopharmaceutical heater 316. The radiopharmaceutical heater 316 may include a lid 318, a body 320, and a heater unit 322. The lid 318, in this embodiment, includes an outer frame 324, handles 326, 328, a radiation shield 330, and a contact member 332. The contact member 332, as explained below, may drive an actuator in the heater unit 322 to bias containers 166. The outer frame 324 may be made of any appropriate material and in any appropriate manner. For instance, the outer frame 324 may be cast and/or machined from metal (e.g., aluminum or steel). This outer frame 324 may include an axle 334 that rotatably couples (e.g., couples in a manner that allows the parts to rotate relative to each other) the lid 318 to the body 320. The illustrated handles 326, 328 may extend in opposite directions from the outer frame 324 and may include features at their ends to facilitate grasping the handles 326, 328 with forceps (e.g., features such as spheres). In this embodiment, the handles 326, 328 are positioned toward the outer edges of the outer frame 324. This is believed to allow easier operation of the lid 324 while enabling a user to avoid line-of-sight radiation exposure from the containers 166. This benefit may be achieved because the handles 326, 328 do not pass through a cylindrical area 335 above the containers 166.

The radiation shield 330 may be coupled to the underside of the outer frame 324 and may include one or more radiation-shielding materials, such as those described herein. In this embodiment, the radiation shield 330 is generally rotationally symmetric and includes features that are generally concentric about a single axis extending through the contact member 332. The radiation shield 330 may include a recessed cavity 338 that overlaps the tops of the containers 166 and a lip 340 that overlaps radiation shielding in the heater unit 322.

The body 320 of the radiopharmaceutical heater 316 includes a top 342, sides 344, 346, a front 348, an angled face 350, and a back 352. These features may generally define an interior 354 that contains the heater unit 322 and electronics 356 for controlling the heater unit 322. In this embodiment, the electronics 356 are external to the radiation shielding in both the lid 324 and in the heater unit 322. This is believed to help keep the electronics 356 cooler. Other embodiments may include other appropriate locations for the electronics 356. The bottom of the body 320 may be connected to a lower assembly similar to that described herein with regard to the lower assembly 168 shown in FIG. 2. Similar to the embodiment shown in FIG. 2, the lower assembly utilized in this embodiment may include one or more spill trays (e.g., 114) to facilitate cleaning the radiopharmaceutical heater 316 after a spill.

The top 342 of the body 320 may include a protrusion 358 that receives the axle 334 and an aperture 360 for accessing the containers 166. Together, the features 358, 334 may form a hinged connection between the lid 324 and the body 320. The angled face 350 may include a display 362. In some embodiments, the display 362 may include or be included with a user interface, such as a touch screen, buttons, or other devices configured to receive input to control the radiopharmaceutical heater 316.

Figure 15:
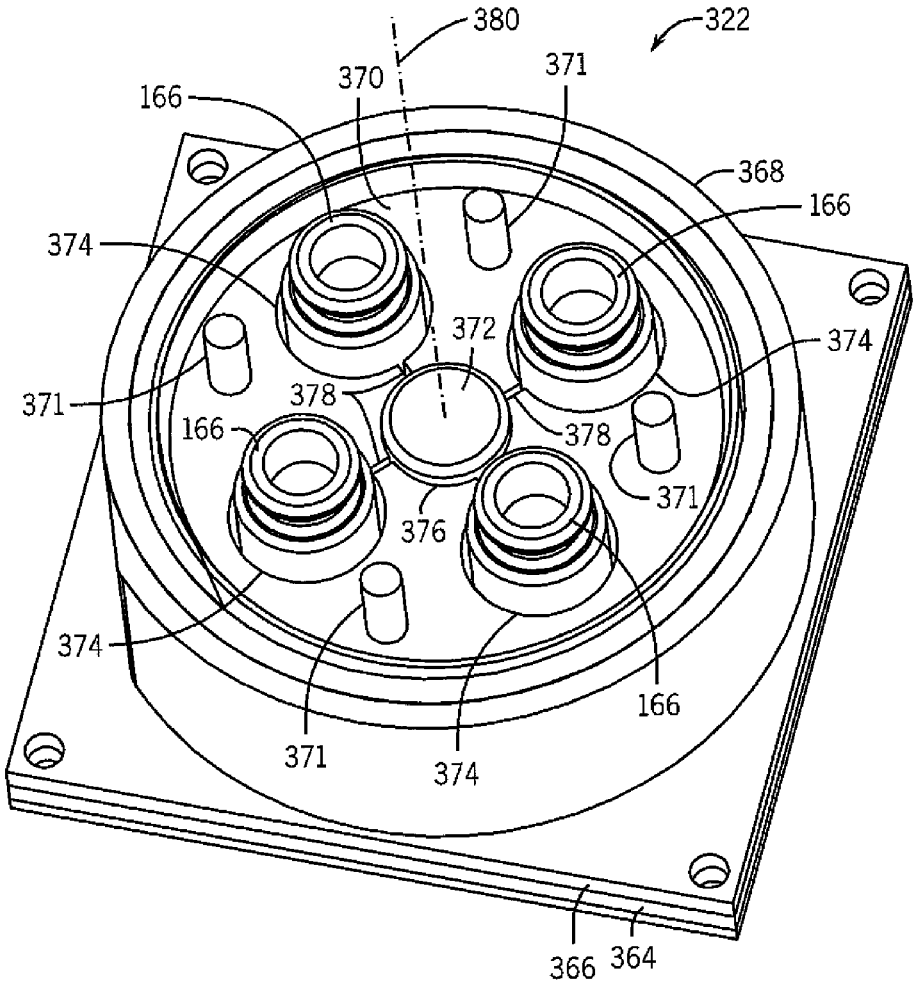
FIG. 15 is a perspective view of a heater unit of the radiopharmaceutical heater shown in FIGS. 12-14.

FIG. 15 illustrates the heater unit 322 of radiopharmaceutical heater 316 in greater detail. The illustrated heater unit 322 may include a support plate 364, a radiation shielding plate 366, side radiation shielding 368, a heater block 370, and an actuator 372. The side radiation shielding 368 may be formed in any appropriate manner such as, for example, by wrapping an elongated sheet of radiation-shielding material, such as one of the examples listed above, around the heater block 370 in a coil. In other embodiments, the side radiation shielding 368 and the radiation shielding plate 366 may be integrally formed as a single component.

The heater block 370 of the heater unit 322 may have a generally right-circular-cylindrical shape having a plurality (e.g., here, four) receptacles 374 connected to a central cavity 376 by corresponding slots 378. The features of the heater block 370 may be generally rotationally symmetric about a central axis 380. The receptacles 374 may be generally right-circular-cylindrical cavities that are slightly larger than the containers 166. In some embodiments, the receptacles 374 may include a CHT member (e.g., 218 of FIG. 9) as an intermediary between the receptacles 374 and the containers 166. The slots 378 of the heater block 370 may be generally straight and of generally uniform width. In the case that the heater block 370 has exactly four receptacles, the slots 378 and the receptacles 374 may be disposed at 90 degree intervals around the central axis 380. The heater block 370 may include radiation-shielding material, such as one or more of those listed above. Further, the heater block 370 may include material selected due, at least in part, to its thermal conductance (e.g., aluminum, copper, or some other material with a high thermal conductivity). In some embodiments, the heater block 370 may include both radiation shielding material and thermally conductive material e.g., it may have a core selected for its thermal conductivity and an outer portion that includes radiation shielding).

In some embodiments, the heater block 370 includes four heating elements 371. The heating elements 371 may be any appropriate heating elements such as, but not limited to, resistive heaters (e.g., coils of wire that convert electrical energy into heat energy by resisting the flow of electricity), and the heating elements 371 may be arranged in any appropriate manner (e.g., they may be arrayed generally at 90 degree intervals around the central axis 380). Other embodiments may include more or fewer heating elements 371 or other types of heating elements, such as the examples listed above.

Figure 16:
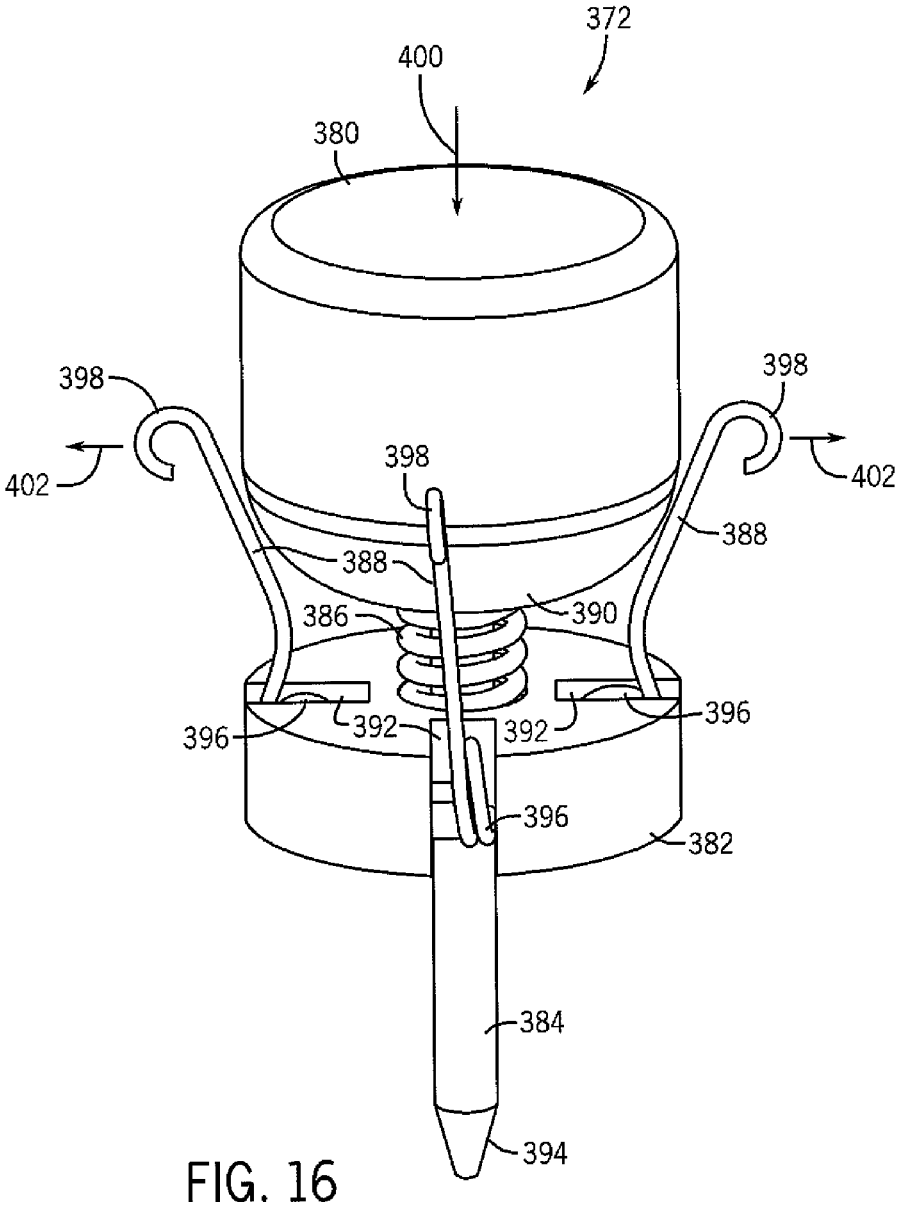
FIG. 16 is perspective view of an actuator of the heater unit shown in FIG. 15.

FIG. 16 illustrates the actuator 372 in greater detail. In this embodiment, the actuator 372 includes a button 380, a frame 382, a guide member 384, a compression spring 386, and actuator arms 388. The button 380 may have a generally right-circular-cylindrical shape with a cam surface 390 (e.g., a surface that, as it moves, pushes against another member and causes that other member to move in a different direction). The cam surface 390 may be curved, angled, flat, or a combination thereof. The frame 382 may have a generally right-circular-cylindrical shape with channels 392 for receiving the ends of the actuator arms 388. The guide member 384 may have a tapered tip 394 and may be generally straight with a generally circular cross-section. The compression spring 386 may be disposed around the guide member 384 between the frame 382 and the button 380. In some embodiments, the compression spring 386 may extend inside the button 380. The illustrated actuator arms 388, each may have a torsion spring 396 at its base and a cam surface 398 at its end. Operation of the actuator 372 is best described in the context of the radiopharmaceutical heater 316.

Figure 17:
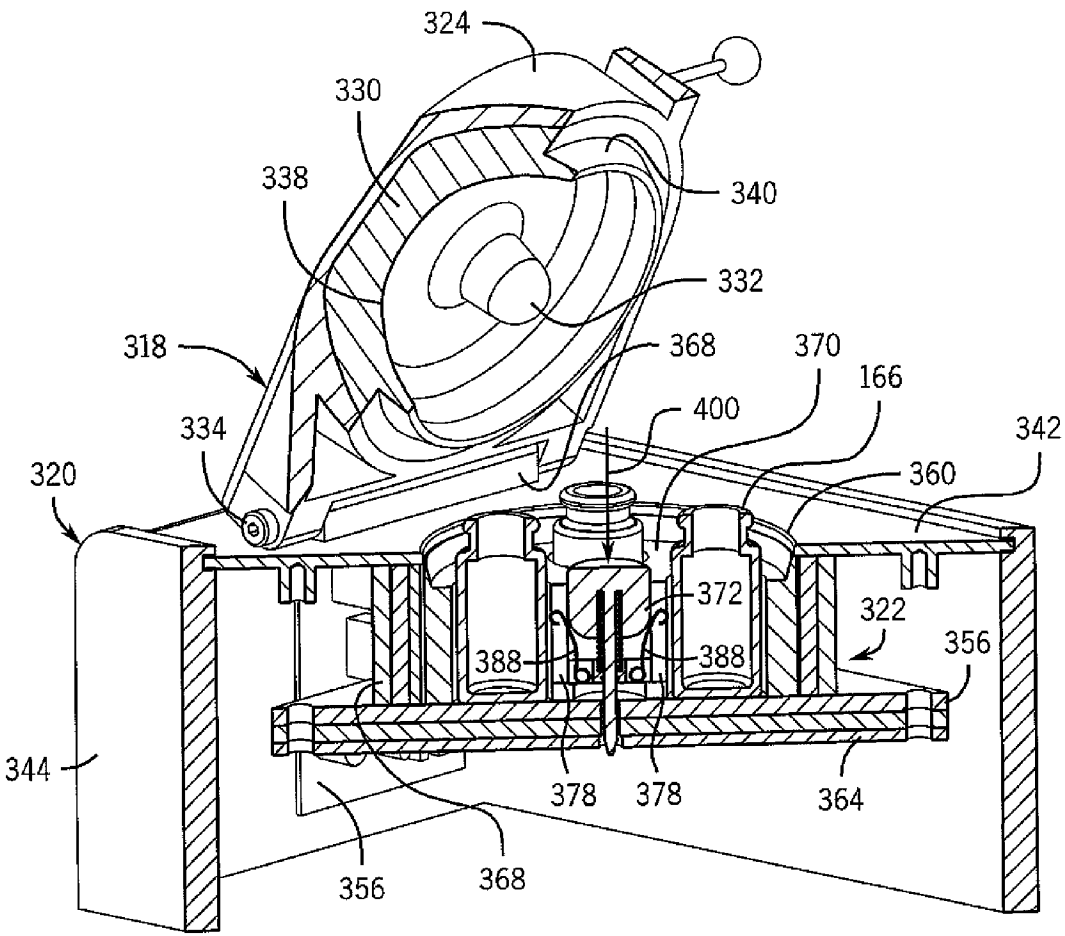
FIGS. 17 and 18 are cross-sections of the radiopharmaceutical heater of FIGS. 12-14 illustrating aspects of its operation.
Figure 18:
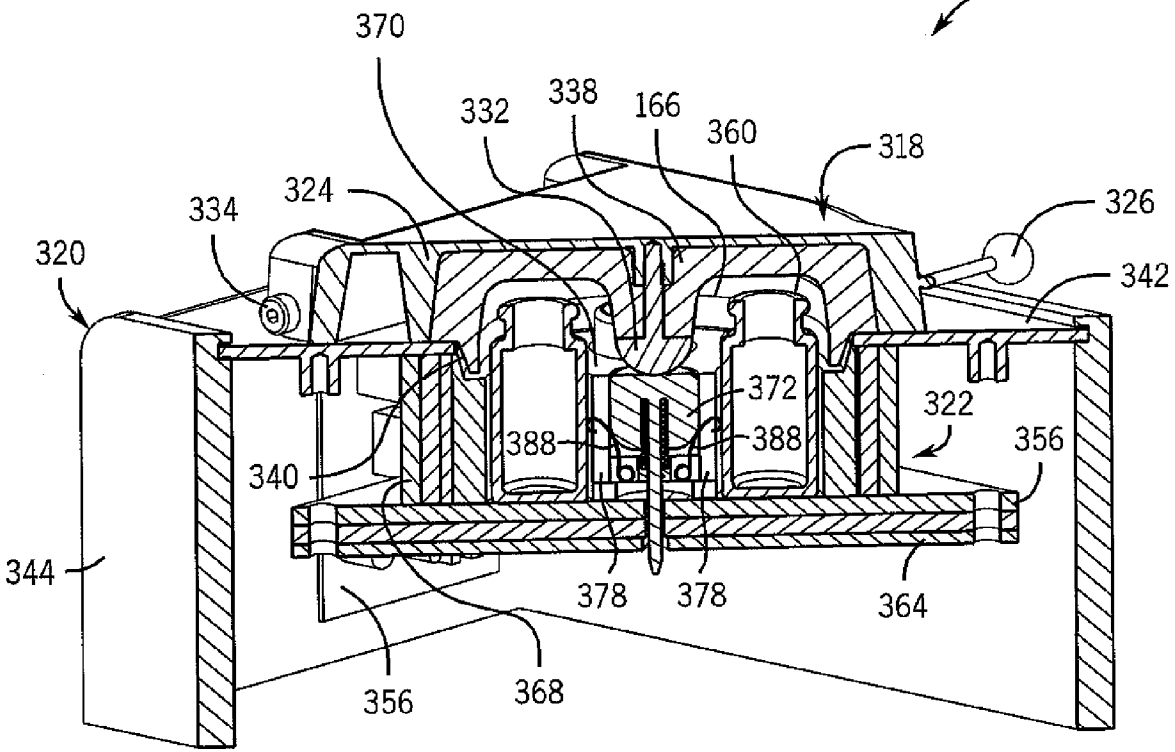

Operation of the radiopharmaceutical heater 316 is illustrated by FIGS. 17-18, though reference is made to FIG. 16 for some of the smaller components of the actuator 372. After the containers 166 are placed in the radiopharmaceutical heater 316, a condition illustrated by FIG. 17, the lid 324 may be closed, as illustrated by FIG. 18. The weight of the lid 324 may be transferred, entirely or in part, through the contact member 322 to the button 380 of the actuator 372. This force may drive the button 380 downward, as illustrated by arrow 400, compressing the compression spring 386 (FIG. 16). As the button 380 moves downward, the cam surface 390 may push the actuator arms 388 radially outward, as illustrated by arrows 402 in FIG. 16. The actuator arms 388 may travel through the slots 378 (FIG. 18) and apply a force to the containers 166. In particular, the cam surfaces 398 of the actuator arms 388 may push the containers 166 radially outward, biasing the containers 166 against the receptacles 374. In embodiments with CHT members, the cam surfaces 398 of the actuator arms 388 may bias the containers against the CHT members, and the CHT members may include a slot for the cam surfaces 398 to contact the containers 166. Biasing the containers 166 against the CHT members or the receptacles 374 is believed to increase the surface area of the containers 166 that is in contact with the heater block 370. In some embodiments, the contact surface area may be greater than or generally equal to 30% of the surface of the container, 40% of the surface of the container, 50% of the surface of the container, or 80% of the surface of the container. This is believed to increase the rate of heat transfer into the container 166.

Figure 19:
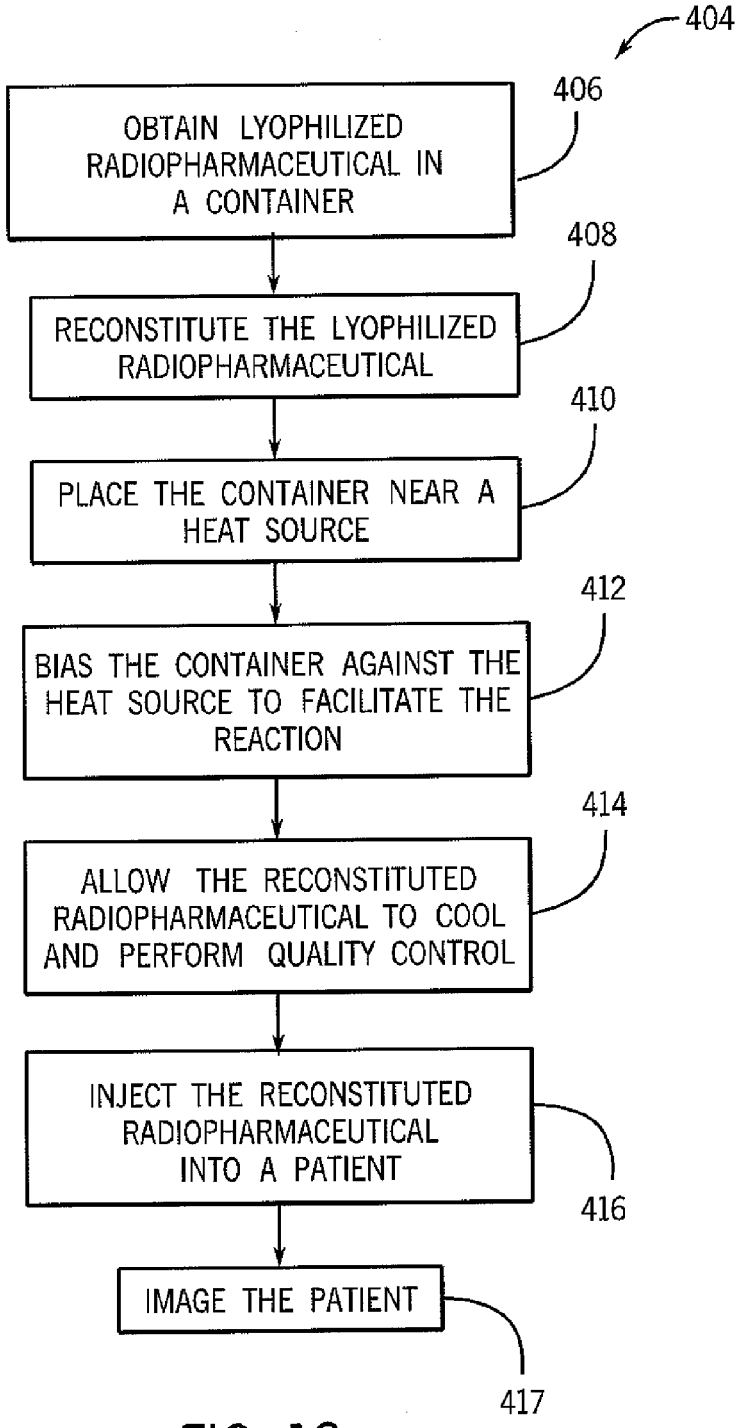
FIG. 19 is a flow chart illustrating a process for preparing and using a radiopharmaceutical.

FIG. 19 illustrates an example of a process for preparing and using a radiopharmaceutical 404. In this embodiment, the process 404 begins with obtaining a lyophilized radiopharmaceutical in a container, as illustrated by block 406.

Next, the lyophilized radiopharmaceutical may be reconstituted, as illustrated by block 408, and the container may be placed near a heat source, as illustrated by block 410. Placing the container near a heat source may include placing the container in one of the radiopharmaceutical heaters described herein. In some embodiments, the container may be placed near the heat source before reconstituting the radiopharmaceutical.

The container may be biased against the heat source, as illustrated by block 412. Biasing the container may include biasing the container against an intermediary member (e.g., a CHT member) disposed between the container and the heat source (e.g., a heated heater block). In some embodiments, biasing may include moving a member (e.g., a spring arm or a heater block) toward the container after the container has been placed near the heat source. Biasing the container against the heat source is believed to increase the surface area of the container in contact with the heat source, thereby potentially increasing the rate of heat transfer into the container. This step 412 may include conducting heat from the heat source to the reconstituted radiopharmaceutical. This step may include heating the container to a target temperature (e.g., generally near 120 degrees Celsius or some other temperature) for generally near 5 to 10 minutes or some other time period.

In some embodiments, reconstituting and heating produces Technetium Tc-99m MAG3 (mercaptoacetylglycylglycylglycine). The Technetium Tc-99m MAG3, one example of a radiopharmaceutical, may be formed in situ after reconstitution with Sodium Pertechnetate Tc-99m Injection and heating of the reaction mixture. Specifically, preparation of this radiopharmaceutical may include complexation of a MAG3 ligand to Tc-99m by adding 99mTcO4- to a lyophilized kit formulation with subsequent heating (e.g., using a heater described herein).

The Tc-99m MAG3 reaction vial may include the generally sterile, non-pyrogenic, non-radioactive, lyophilized mixture of 4 components: betiatide, the benzoyl protected precursor to mertiatide; stannous (Sn2+) chloride dihydrate as a reducing agent; sodium tartrate as a transfer ligand; and lactose as a filler/bulking agent. The tartrate initially chelates reduced technetium, and the mertiatide is the N3S (MAG3) ligand that ultimately coordinates to Tc-99m to form the Tc-99m MAG3 renal imaging agent. Upon reconstitution with Tc-99m generator eluant, Na99mTc(VII)O4, the ligand exchange labeling process may be as follows.

$^{99m}Tc(VII)O_4^{1-}+Sn^{2+}+tartrate \rightarrow {}^{99m}Tc(V)O^{3+}+Sn^{4+}$, stannous ion reduces technetium from +7 to +5, $^{99m}Tc(V)O^{3+}+tartrate \rightarrow {}^{99m}Tc(V)O\text{-}tartrate$, reduced oxotechnetium initially chelates to tartrate, $^{99m}Tc(V)O\text{-}tartrate+betiatide \xrightarrow{heat} tartrate+{}^{99m}Tc(V)O\text{-}mertiatide$ The heating may facilitate removal of the benzoyl sulfur protecting group so that the stronger mertiatide chelating agent can displace the tartrate from the oxotechnetium(V) center.

In some embodiments, reconstitution and heating may form Technetium Tc-99m Sestamibi, another example of a radiopharmaceutical. The Technetium Tc-99m Sestamibi may be formed in situ after reconstitution with Sodium Pertechnetate Tc-99m Injection and heating of the reaction mixture. Specifically, preparation of this radiopharmaceutical may include complexation of six MIBI (2-methoxyisobutylisonitrile) ligands to Tc-99m by adding 99mTcO4- to a lyophilized kit formulation with subsequent heating. MIBI, like most isonitrile ligands, is a volatile liquid and quite susceptible to polymerization and oxidative decomposition, thus making it very difficult to formulate into a stable kit. In order to stabilize the MIBI ligand during formulation and lyophilization, it is complexed to Cu(I), which produces a solid, relatively stable copper (I) complex, [Cu(MIBI)4]BF4.

During kit preparation, MIBI is released from the copper complex and transchelated to the Tc-99m.

The Tc-99m sestamibi reaction vial includes the generally sterile, non-pyrogenic, non-radioactive, lyophilized mixture of the chelating ligand in the form of a copper (I) salt i.e. [Cu(MIBI)4]BF4; sodium citrate dihydrate as a buffer; L-cysteine hydrochloride monohydrate as an auxiliary reductant and transfer ligand; mannitol as a filler/bulking agent; and stannous chloride dihydrate as the primary reducing agent. Upon reconstitution with Tc-99m generator eluant, Na99mTc(VII)O4, the labeling process may be as follows.

$^{99m}Tc(VII)O4^{1-}+Sn^{2+}+cysteine \rightarrow {}^{99m}Tc(V)O^{3+}+Sn^{4+}$, stannous ion reduces technetium from +7 to +5, $^{99m}Tc(V)O^{3+}+cysteine \rightarrow {}^{99m}Tc(V)O\text{-}cysteine$, reduced oxotechnetium initially chelates to cysteine $^{99m}Tc(V)O\text{-}cysteine+[Cu(MIBI)_4]BF_4+Sn^{2+}+cysteine \xrightarrow{heat} +{}^{99mTc}(I)[MIBI]_6$ In some embodiments, heating reduces the oxotechnetium (V) down to technetium (I).

After heating, the reconstituted radiopharmaceutical is cooled and verified with quality control measures, as illustrated by block 414.

Finally, the reconstituted radiopharmaceutical may be injected into a patient or other organism, as illustrated by block 416, and the patient or organism may be imaged, as illustrated by block 417. Imaging may include imaging breast tissue, parathyroid glands, or heart tissue, with a gamma camera or other imaging device. In some forms of cardiac imaging, the imaging may be preceded by a stress test. In some embodiments, the radioactive material may concentrate near tissue with certain properties (e.g., malignant tissue) and imaging may help identify that tissue. In other embodiments, the radiopharmaceutical may be used as a therapeutic rather than as a diagnostic imaging agent.

Figure 20:
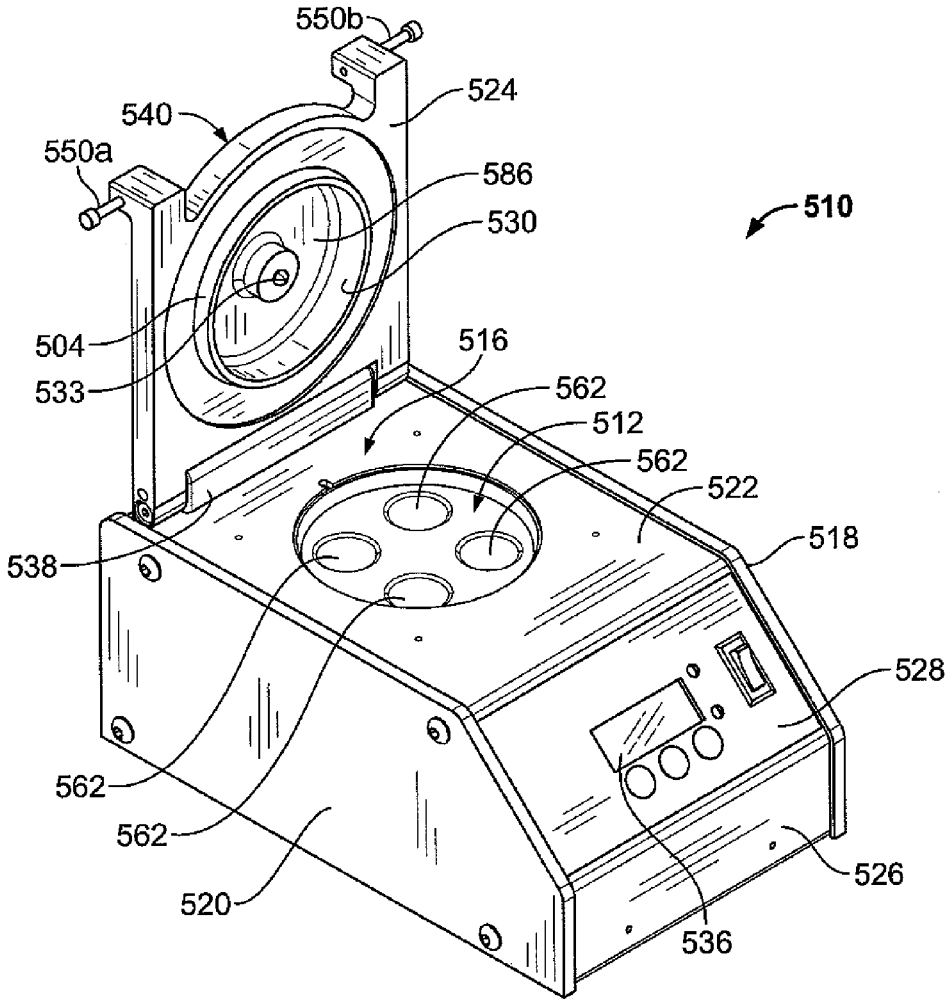
FIGS. 20 and 21 are perspective views of yet another radiopharmaceutical heater with a lid of the heater being in an opened position.
Figure 21:
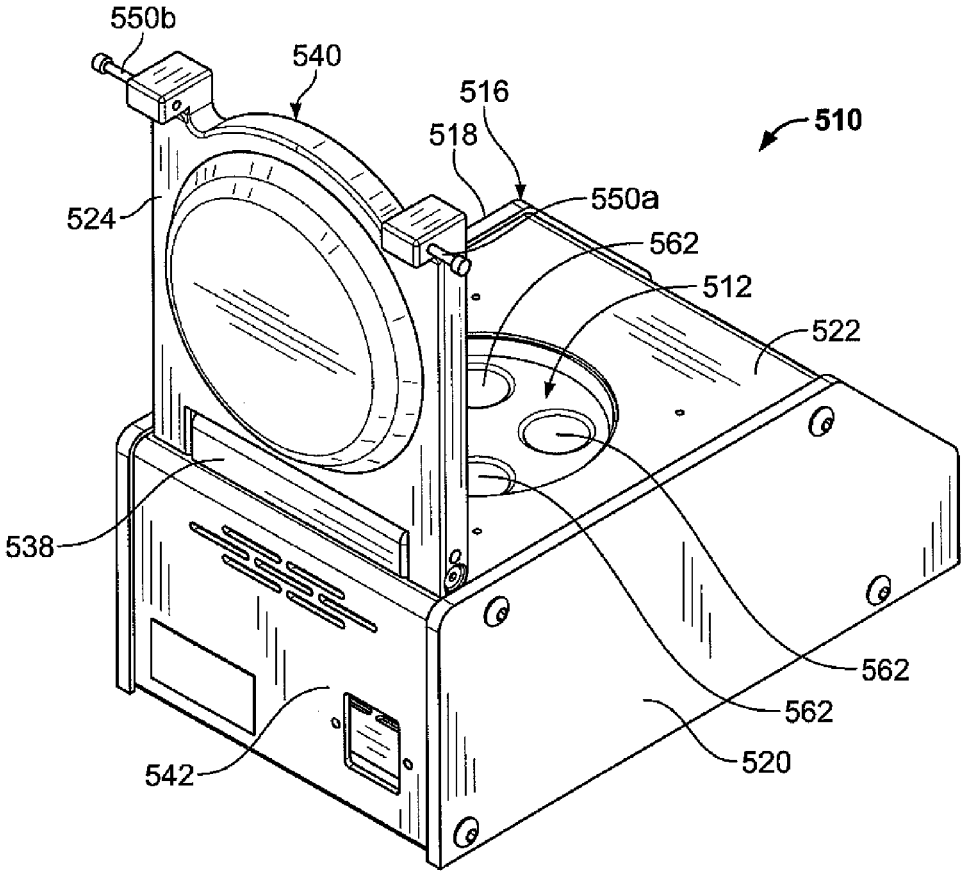
Figure 22:
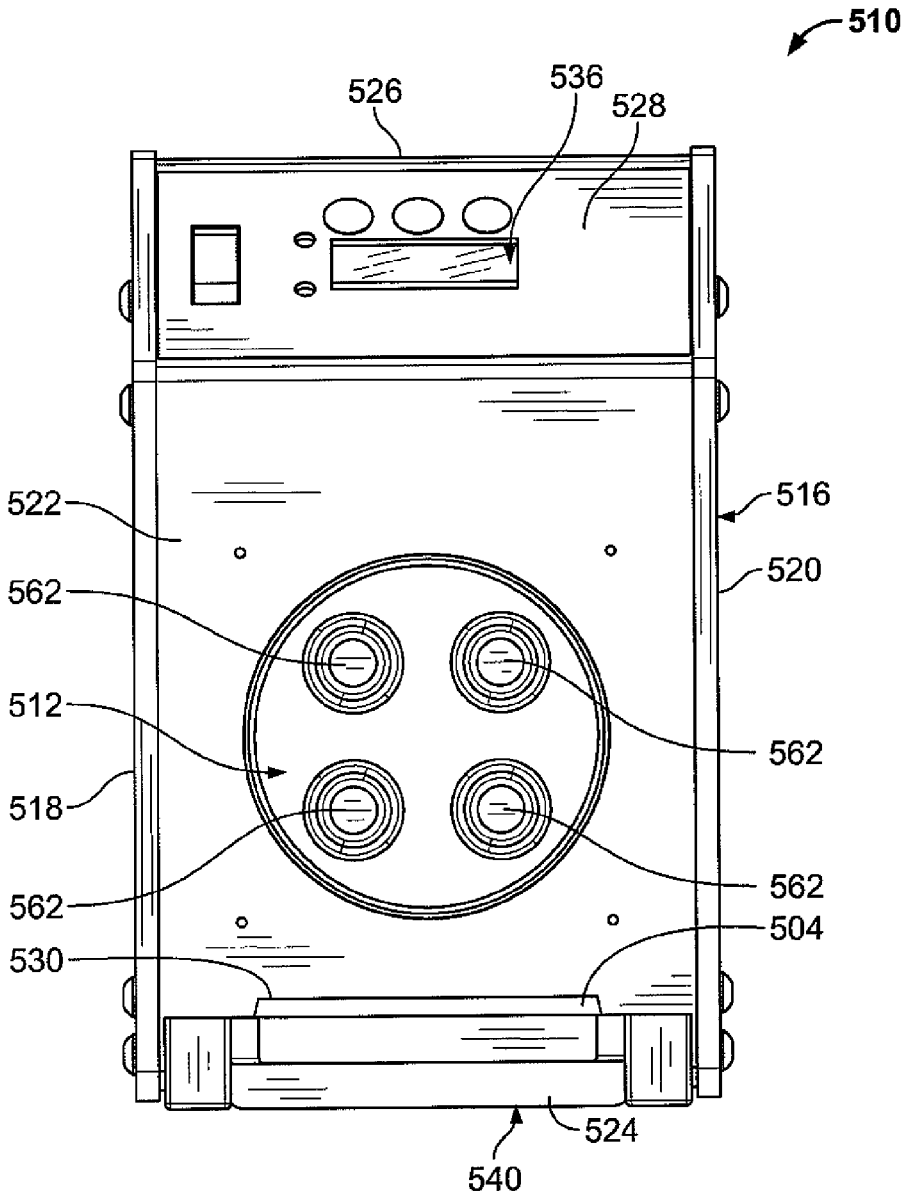
FIG. 22 is a top plan view of the radiopharmaceutical heater of FIGS. 20 and 21.
Figure 23:
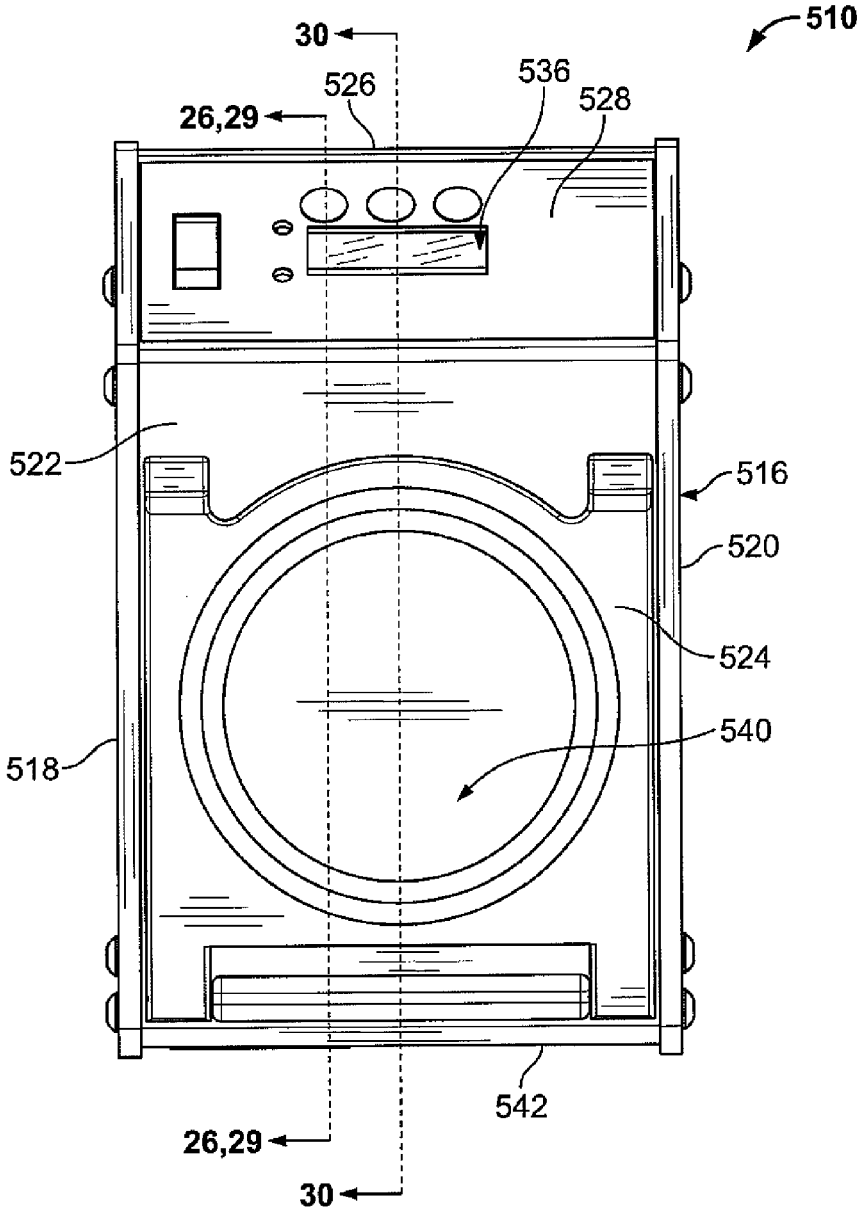
FIG. 23 is a top plan view similar to FIG. 22 but showing the lid of the heater in a closed position.
Figure 24:
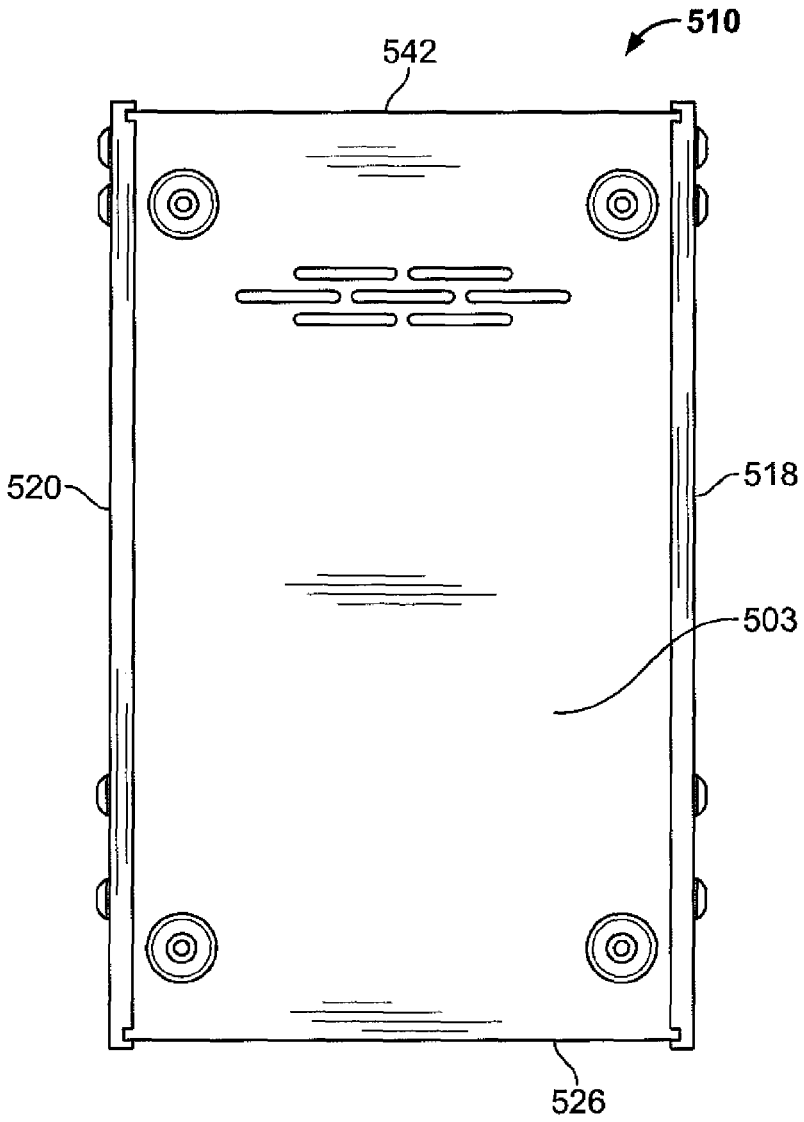
FIG. 24 is a bottom plan view of the radiopharmaceutical heater of FIG. 20.
Figure 25:
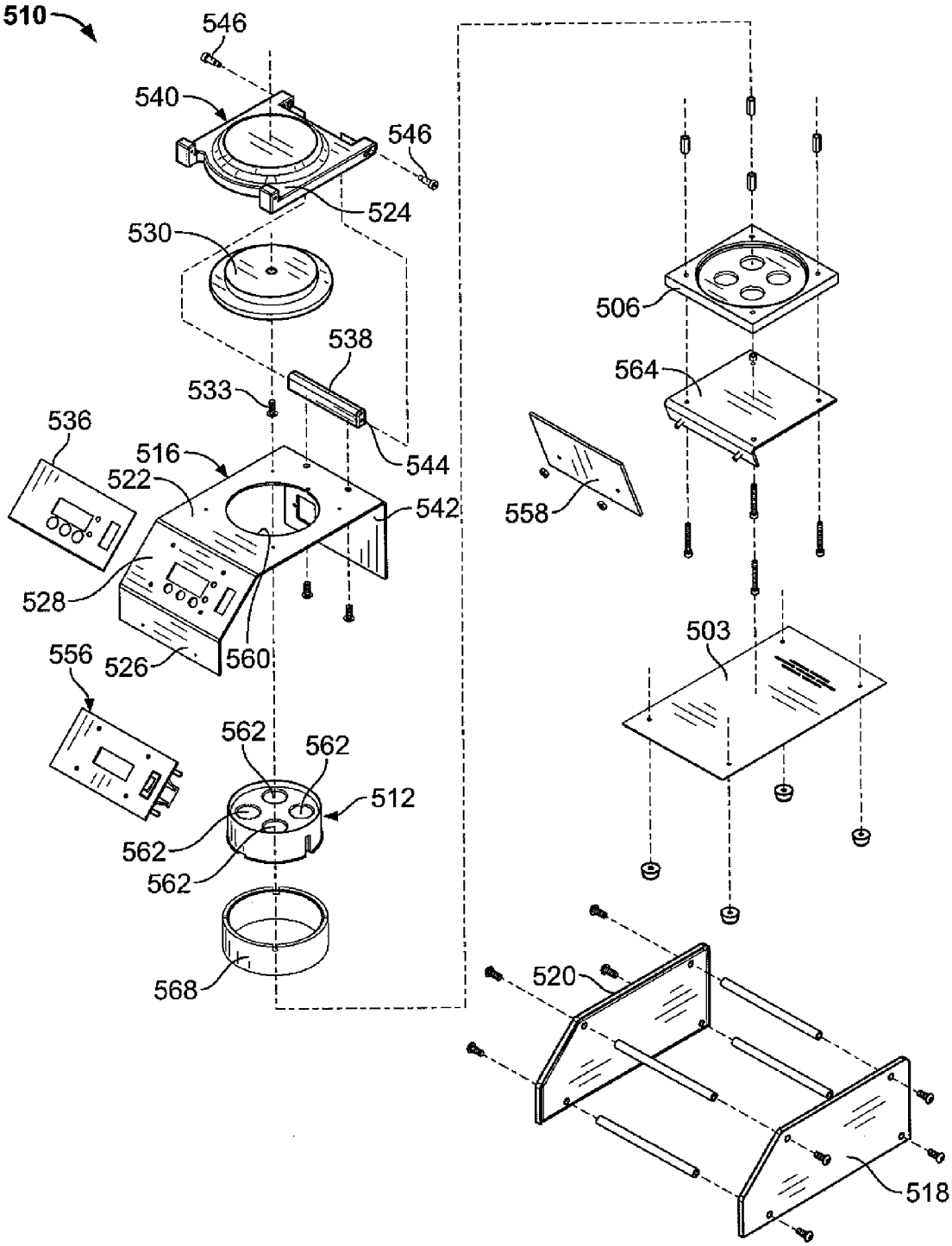
FIG. 25 is an exploded perspective view of the radiopharmaceutical heater.
Figure 26:
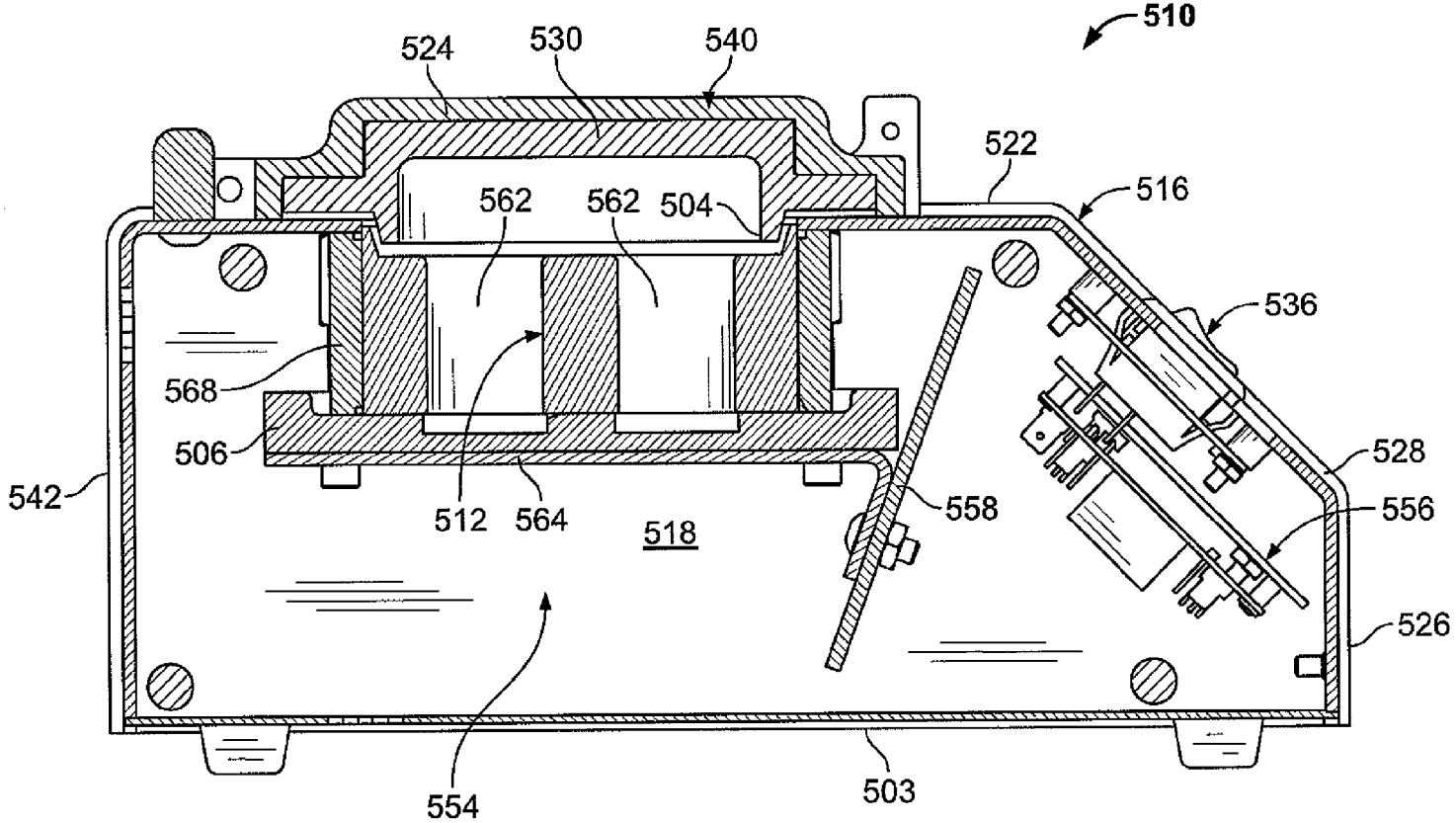
FIG. 26 is a cross-section of the radiopharmaceutical heater taken along line 26-26 of FIG. 23.
Figure 27:
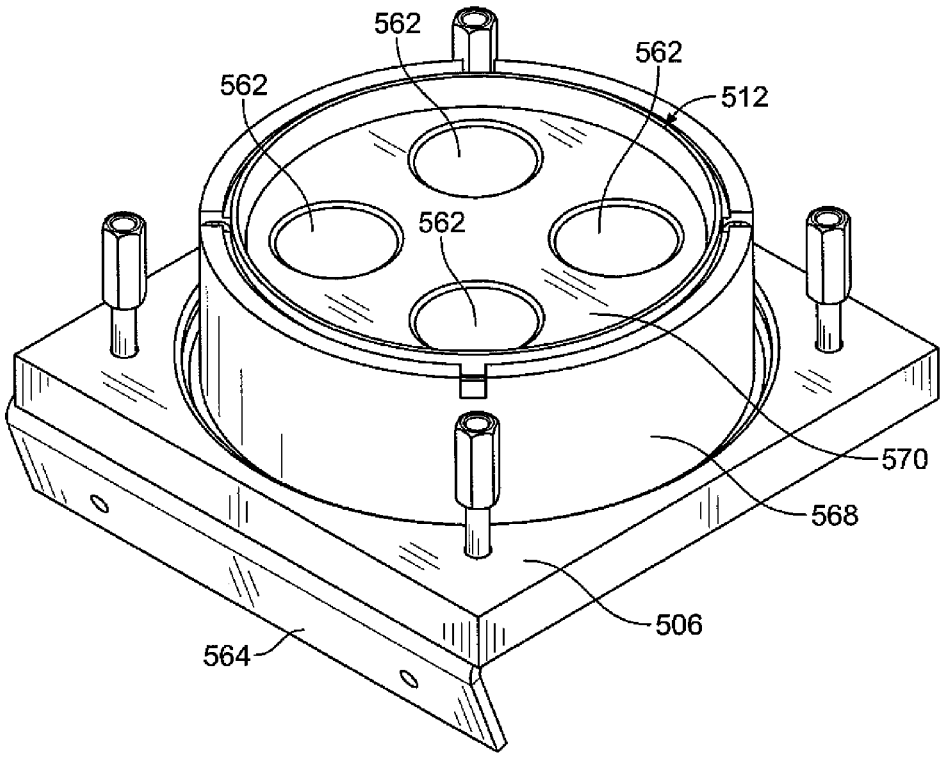
FIG. 27 is a perspective view of a heater unit removed from the radiopharmaceutical heater.
Figure 28:
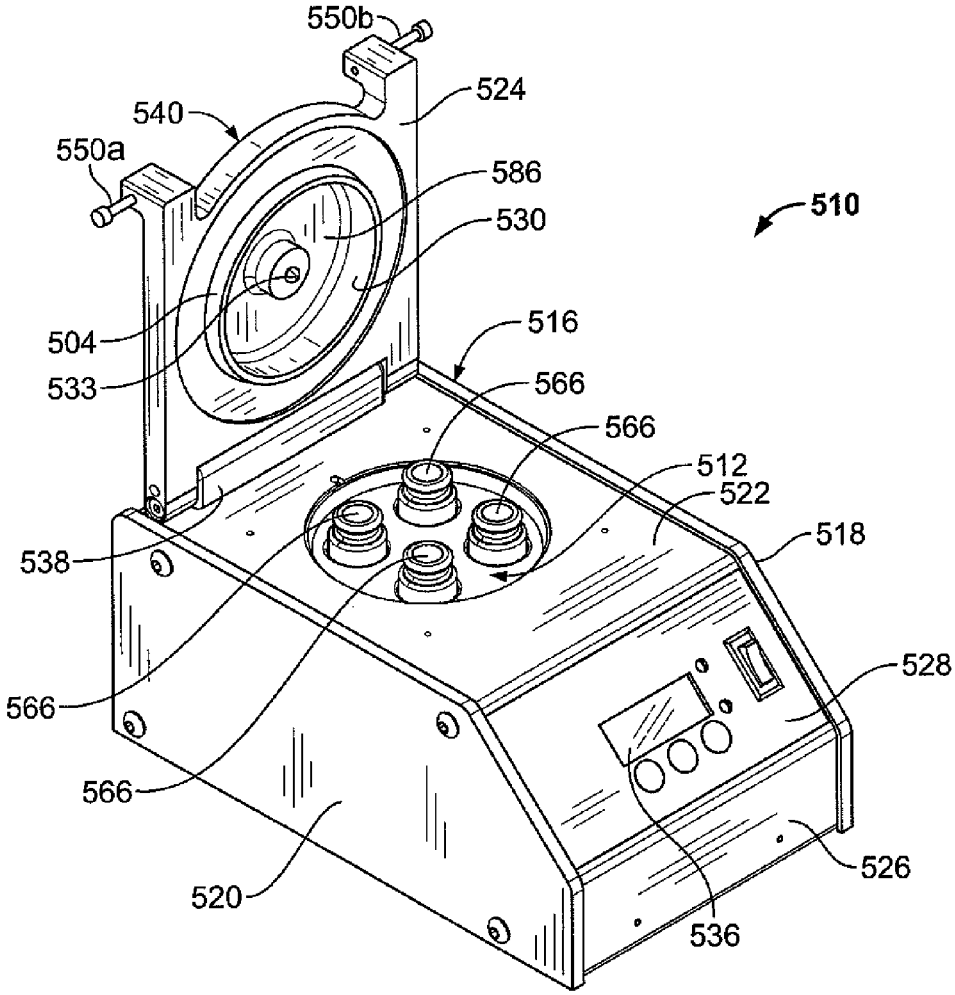
FIG. 28 is a perspective view similar to FIG. 20 but showing containers of radiopharmaceuticals received in the heater unit.

FIGS. 20-30 illustrate another example of a radiopharmaceutical heater, which is indicated generally at 510. With reference to FIGS. 20 and 21, the radiopharmaceutical heater 510 includes a body 516, a lid 540 hingedly attached to the body, and a heater unit 512 received in the body. The lid 540, in the illustrated embodiment, includes an outer frame 524, handles 550*a*, 550*b*, and a radiation shield 530. The outer frame 524 can be made of any appropriate material and in any appropriate manner. For instance and as illustrated in the accompanying drawings, the outer frame 524 can be cast and/or machined from metal (e.g., aluminum or steel). The illustrated handles 550*a*, 550*b* extend in opposite directions from the outer frame 524 and include features (e.g., spheres) at their ends to facilitate grasping the handles with forceps. In the illustrated embodiment, the handles 550*a*, 550*b* are positioned toward the outer edge of the outer frame 524. This is believed to allow easier operation of the lid 540 while enabling a user to avoid line-of-sight radiation exposure from containers 566 received in the heater unit 512 (FIG. 28). This benefit may be achieved because the handles 550*a*, 550*b* do not pass through a projected cylindrical volume located above the containers 566. In other words, when the handles 550*a*, 550*b* are grasped and pivoted upward or downward with respect to the body 516 to open or close the lid 540, the handles do not pass over the heater unit 512. In one suitable embodiment, the lid 540 is hingedly connected to the body 516 (e.g., couples in a manner that allows the lid to rotate relative to the body) using a pair of bolts 546 (FIG. 25). However, the lid 540 can be hingedly connected to the body 516 in other suitable ways (e.g., using an axial). In one embodiment, the lid 540 is capable of staying generally upright (e.g., generally perpendicular to the top 522 of the body 516) when opened.

With reference now to FIGS. 20 and 25, the radiation shield 530 of the lid 540 is coupled (e.g., by bolt 533) to the underside of the outer frame 524 and comprises one or more radiation-shielding materials, such as those described herein. In the illustrated embodiment, the radiation shield 530 is generally symmetric about the bolt 533 and includes a recessed cavity 586 and an annular lip 504 surrounding the cavity. The radiation shield 530 can have different shapes and configurations than illustrated herein. It is also understood that the lid 540 can be formed from as a single-piece. In a single-piece embodiment, the entire lid can be formed from radiation-shielding materials.

With reference again to FIG. 25, the body 516 of the radiopharmaceutical heater 510 includes a top 522, sides 520, 518, a front 526, an angled face 528, a back 542, and a bottom 503. In the illustrated embodiment, the top 522, front 526, angled face 528, and back 542 are formed as a single-piece and the sides 520, 518 and bottom 503 are coupled thereto using suitable fasteners (i.e., bolts and spacers). More or fewer parts of the body 516 can be formed as a single-piece with any other components being attached thereto. The top 522 of the body 516 includes a protrusion 538 (or hinge block) affixed thereto (e.g., bolted) having holes 544 therein for receiving the bolts 546 used to pivotally mount the lid 540 to the body 516. The top 522 also includes an aperture 560 for accessing the heater unit 512 and more specifically containers 566 received in the heater unit. As seen in FIGS. 21 and 24, the back 542 and bottom 503 of the body 516 include a plurality of ventilation slots.

As seen in FIG. 26, the body 516 generally defines an interior 554 that contains the heater unit 512 and electronics 556 for controlling the heater unit. In the illustrated embodiment, the electronics 556 are external to the radiation shielding in both the lid 540 and in the heater unit 512. This is believed to help keep the electronics 556 cooler. In addition, in the illustrated embodiment, an insulating barrier 558 is disposed between the electronics 556 and the heater unit 512 for isolating the electronics from the heater unit. Other embodiments may include other appropriate locations for the electronics 556. In the illustrated embodiment, the angled face 528 includes a display 536. In some embodiments, the display 536 may include or be included with a user interface, such as a touch screen, buttons, or other devices configured to receive input to control the radiopharmaceutical heater 510. For example, in one embodiment, the user interface allows the user to turn the heater 510 on and off and to adjust the desired set point temperature to which to heat the radiopharmaceuticals disposed in the containers 566 in increments of 0.1° C. The illustrated radiopharmaceutical heater 510 has a set point temperature with a range between about 200° C. and about 1250° C. The set point temperature can, however, have different ranges. In one embodiment, the electronics 556 include a fuse (not shown) and fuse housing that is accessible through the body 516.

Figure 30:
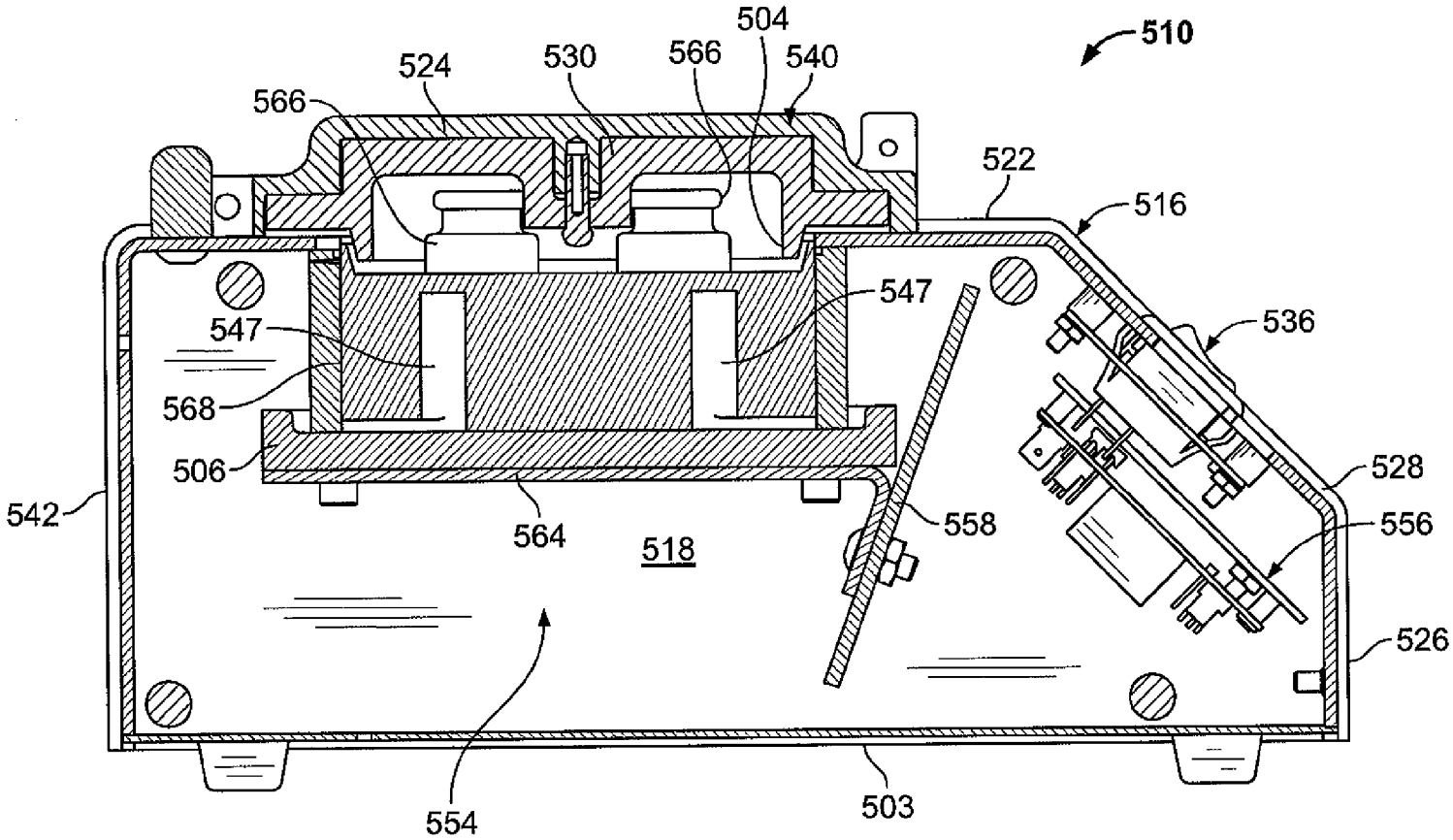
FIG. 30 is a cross-section is a section of the radiopharmaceutical heater taken along line 30-30 of FIG. 23 but showing the containers of radiopharmaceuticals received in the heater unit.

FIGS. 27 and 30 illustrate the heater unit 512 of the radiopharmaceutical heater 510 in greater detail. The illustrated heater unit 512 includes a support plate 564, a radiation shielding plate 506, a side radiation shield 568, a heater block 570 (broadly, a "heat-transfer member"), and heating elements 547. The side radiation shield 568 can be formed in any appropriate manner such as, for example, by wrapping an elongated sheet of radiation-shielding material, such as one of the examples listed above, around the heater block 570. In other embodiments, the side radiation shield 568 and the radiation shielding plate 506 may be integrally formed as a single component. In the illustrated embodiment, the heater block 570 of the heater unit 512 has a generally cylindrical shape and includes a plurality (e.g., four) of receptacles 562. The heater block 570 can have different shapes and can include more or fewer receptacles 562. Each of the illustrated receptacles 562 is a generally cylindrical cavity that is slightly larger than the container 566. Thus, each receptacle 562 is configured to receive one container 566 therein. The heater block 570 may include radiation-shielding material, such as one or more of those listed above. Further, the heater block 570 may include material selected for, at least in part, its thermal conductance (e.g., a material with a high thermal conductivity).

In one embodiment, the heater block 570 is formed substantially or entirely from a material having a high thermal conductivity, for example, a material having a thermal conductivity between about 100 W/(mK) and about 400 W/(mK). In one suitable embodiment, the heater block 570 is formed from material having a thermal conductivity between about 150 W/(mK) and about 300 W/(mK). In a more suitable embodiment, the heater block 570 is formed from material having a thermal conductivity of about 200 W/(mK). In another embodiment, the heater block 570 is formed from a material having a thermal conductivity selected from a group including greater than about 100 W/(mK); greater than about 170 W/(mK); greater than about 190 W/(mK); greater than about 210 W/(mK); greater than about 220 W/(mK); greater than about 230 W/(mK); and greater than about 240 W/(mK). Example materials include aluminum and copper. In some embodiments, the heater block 570 may include both radiation shielding material and thermally conductive material e.g., it may have a core selected for its thermal conductivity and an outer portion that includes radiation shielding).

In the illustrated embodiment, each of the heating elements 547 is disposed entirely within the heater block 570 and the radiation-shielding material. It is contemplated, however, that only a part of each of the heating elements 547 may be disposed with the heater block 570 and/or the radiation-shielding material without departing from the scope of this invention. Each of the heating elements 547 of the heater block 570 may be resistive heating elements, Peltier heating elements, induction heating elements, fluid-to-solid heat exchangers, fluid-to-fluid heat exchangers, or other type(s) of heating elements configured to deliver heat energy to the heating block. The illustrated embodiment includes four heating elements 547 (only two heating elements being seen in FIG. 30) with one of the heating elements 547 being disposed adjacent respective ones of the receptacles 562. In one suitable embodiment, the heating elements 547 are adapted to cooperatively heat the heater block 570 up to 125° C.

Figure 29:
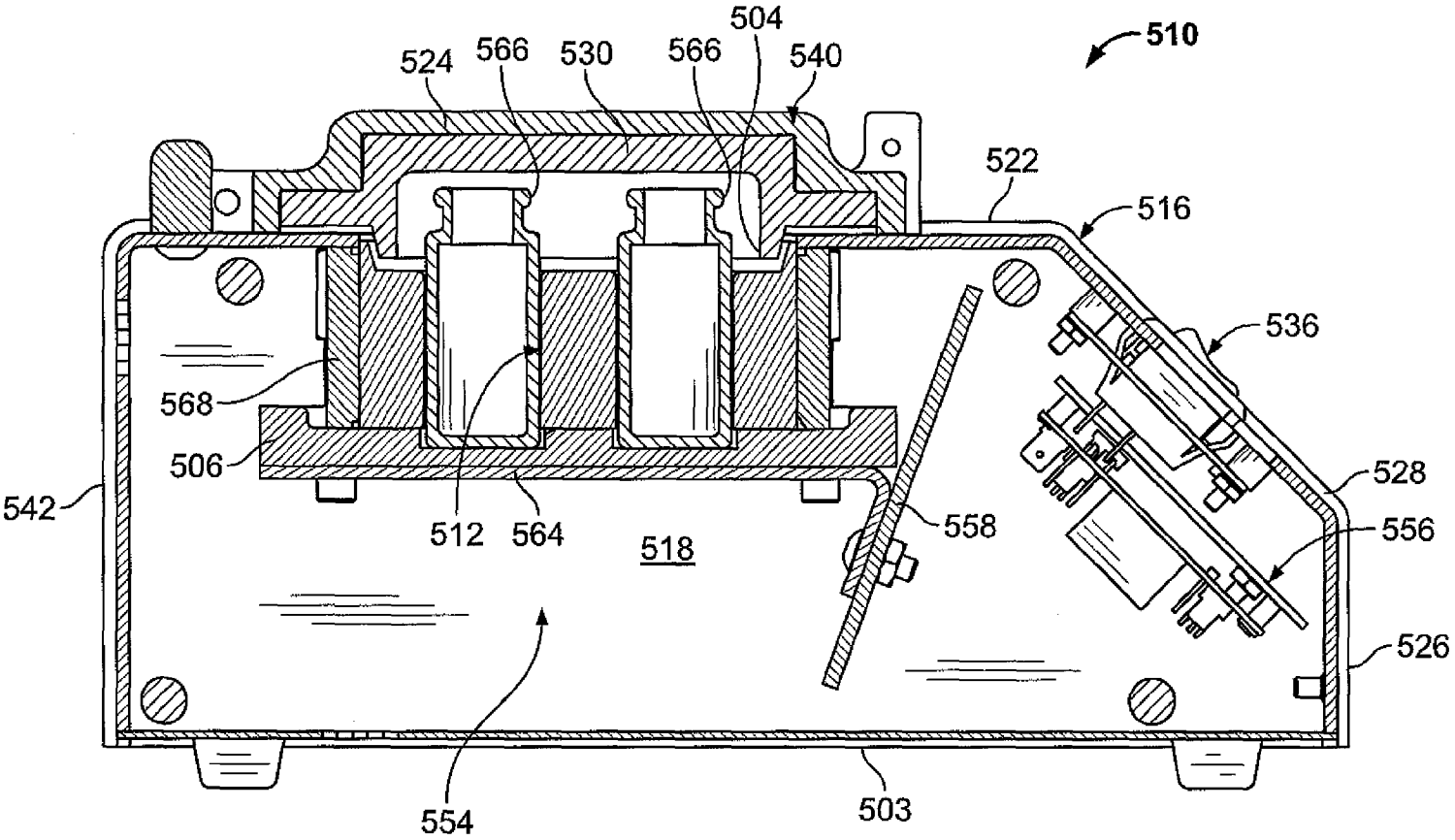
FIG. 29 is a cross-section similar to FIG. 26 but showing the containers of radiopharmaceuticals received in the heater unit.

Operation of the radiopharmaceutical heater 510 is illustrated by FIGS. 28-30. In the illustrated embodiment, up to four containers 566 having a radiopharmaceutical therein are placed in respective receptacles 562 of the heater block 570 of the heater unit 512. As seen in FIG. 29, the receptacles 562 defined in the heater block 570 are sized and shaped to receive at least 50% of a container when the container is disposed in the receptacle and more specifically to receive approximately 70% of the container. In the illustrated embodiment, the clearance between the heater block 570 and the receptacles 562 is less than about 0.001 inches (0.0254 mm). After the containers 566 are placed in the radiopharmaceutical heater 510 (FIG. 28), the lid 540 is moved using at least one of the handles 550*a*, 550*b* of the lid from an opened position to a closed position (FIG. 18). In certain embodiments, the container 566 may be heated from a starting temperature, such as room temperature or a recommended storage temperature for a radiopharmaceutical in the container 566 (e.g., between 15 and 25 degrees Celsius) to a target temperature (e.g., between 95 and 98 degrees Celsius, or greater than or generally equal to 105 degrees Celsius, 115 degrees Celsius, or 120 degrees Celsius) in less than 15 minutes, less than 10 minutes, less than 8 minutes, less than 6 minutes, or less than 4 minutes. The heater unit 512 may, in some instances, maintain a temperature of the container 566 within plus or minus 2 degrees Celsius of the target temperature. The volume of radiopharmaceutical in the container 566 may be greater than, less than, or generally equal to 10 mL, 30 mL, 50 mL, 100 mL, or 150 mL.

After a period of time and after the radiopharmaceutical is heated to the desired temperature, the container 566 may be removed from the heater unit 512. To remove the container 566, the lid 540 is moved from its closed position to its opened position using at least one of the handles 550*a*, 550. With the lid 540 opened, one or more of the container 566 can be removed from the radiopharmaceutical heater 510.

Instructions for operating the radiopharmaceutical heater 510 can be supplied along with the heater. In one example, the instructions can include the following information.

Operation

1. Place unit inside a Plexiglass enclosure.
2. Plug in power cord to an electrical outlet and into back of heating unit. The power cord will need to be run through the grommet in the back of the Plexiglass enclosure. Silicone caulk will need to be placed around the opening through which the power cord is run through, thus creating a complete seal.
3. Turn unit ON with the "ON/OFF" (I/O) switch.
4. Use the ACT/SET button to toggle between the Actual temperature (green light will be lit) and the Set Point temperature (red light will be lit). The respective lights will light to indicate which setting it is on. The Set Point temperature has a range of 200° C. to 1250° C.
5. When in Set Point mode, use the up and down buttons for setting the desired temperature of 1250° C.
6. Toggle back to Actual temperature. Once the Actual temperature stabilizes (this may take up to 15 minutes) at 1250° C., the heating unit is ready to heat product. (The Actual temperature must be 1200° to 1250° C.). The Actual Temperature display may fluctuate above 1250° C. for short periods as the unit stabilizes.
7. Use properly disinfected, extended length tongs to open the lid of the heating unit and place vials into vial holder.
8. Close lid to heating unit using the extended length tongs.
9. After the vials have been heated, open lid and remove vials by carefully using extended length tongs. CAUTION: UNIT WILL BE HOT!
10. It is recommended to either leave the heating unit continuously on or plug into a timer.

If Pharmacy Desires to turn Heating Unit Off:

11. Turn unit off with the "ON/OFF" (I/O) switch.
12. Unplug from the electrical outlet.

Maintenance

1. For spills on heater wipe with towel and use caution while heater is still warm.
2. Fuse can be replaced with a standard 5×20 mm 10 Amp fuse if necessary (located at the power entry module.)

Troubleshooting

The unit is equipped with an electronic board that has been calibrated via computer link to ensure proper operating temperature. The power supply fluctuates during operation to keep the temperature accurate. The electrical board has been calibrated so that the Set point range is 200° C. to 1250° C. The Actual readout may fluctuate above 1250° C. for short periods during operation. At no time should the Actual temperature be above 1300° C. Contact Pharmacy Support or the Pharmacy Quality Department for assistance immediately if you have concerns or question.

While the invention may be susceptible to various modifications and alternative forms, specific embodiments have been shown by way of example in the figures and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A radiopharmaceutical heater comprising:

a heat-transfer member having a receptacle defined therein to receive a container, the heat-transfer member having a thermal conductivity greater than about 100 W/(mK);

a radiation shield disposed about the heat-transfer member, wherein the radiation shield comprises lead, tungsten, tungsten-impregnated plastic, depleted uranium, or any combination thereof;

a heating element in thermal communication with the heat-transfer member, wherein at least a portion of the heating element is located within the radiation shield; and an actuator configured to bias the heat-transfer member against the container to facilitate heat transfer between the heating element and the container.

2. The heater of claim 1, wherein an entirety of the heating element is located within the radiation shield.

3. The heater of claim 1, wherein at least the portion of the heating element is located within the heat-transfer member.

4. The heater of claim 1, further comprising the container having a radiopharmaceutical disposed therein, wherein the container is disposed within the receptacle defined in the heat-transfer member.

5. The heater of claim 4, wherein a clearance between the container and a portion of the heat-transfer member that defines the receptacle is no more than about 0.001 inches (0.0254 mm).

6. The heater of claim 1, wherein at least a portion of the heat-transfer member comprises aluminum.

7. The heater of claim 1, wherein the thermal conductivity of the heat-transfer member is greater than about 150 W/(mK).

8. A radiopharmaceutical heater comprising:

a compliant heat-transfer member shaped to receive a container;

a radiation shield disposed near the compliant heat-transfer member;

a heating element in thermal communication with the compliant heat-transfer member; and an actuator configured to bias the compliant heat-transfer member against the container to facilitate heat transfer between the heating element and the container.

9. The heater of claim 8, wherein the compliant heat-transfer member comprises silicone, poly-tetraflouroethane, or a combination thereof.

10. The heater of claim 8, wherein the radiation shield comprises:

a first radiation-shield member; and a second radiation-shield member coupled to the first radiation-shield member with two or fewer degrees of freedom of relative movement between the first radiation-shield member and the second radiation-shield member.

11. The heater of claim 10, wherein the actuator comprises:

a shaft;

a cam affixed to the shaft;

a lever affixed to the shaft and configured to rotate the cam; and a guide-member coupled to the first radiation-shield member, wherein the cam is configured to move the first radiation-shield member along a path defined by the guide-member, and wherein the path is toward the second radiation-shield member.

12. The heater of claim 8 further comprising a spill tray disposed at least partially under the radiation shielding.

13. The heater of claim 12, wherein the spill tray comprises a slide rail.

14. The heater of claim 12, wherein the spill tray comprises an absorbent medium.

* * * * *